US009382058B2

(12) United States Patent
Konkin

(10) Patent No.: US 9,382,058 B2
(45) Date of Patent: Jul. 5, 2016

(54) FOLDABLE CONTAINER SLEEVE

(71) Applicant: Barry Konkin, Vancouver (CA)

(72) Inventor: Barry Konkin, Vancouver (CA)

( * ) Notice: Subject to any disclaimer, the term of this patent is extended or adjusted under 35 U.S.C. 154(b) by 0 days.

(21) Appl. No.: 13/951,144

(22) Filed: Jul. 25, 2013

(65) Prior Publication Data

US 2014/0038804 A1 Feb. 6, 2014

Related U.S. Application Data

(60) Provisional application No. 61/679,010, filed on Aug. 2, 2012.

(51) Int. Cl.

| | |
|---|---|
| ***B65D 81/38*** | (2006.01) |
| ***B65D 59/04*** | (2006.01) |
| *A47G 23/02* | (2006.01) |

(52) U.S. Cl.

CPC ..... *B65D 81/3876* (2013.01); *B65D 59/04* (2013.01); *A47G 23/0208* (2013.01)

(58) Field of Classification Search

CPC ..... B65D 81/3876; B65D 81/3893; B65D 59/04; B65D 25/20; A47G 2023/0291; A47G 2023/0283; A47G 23/0216; A47G 23/0208; B31C 7/02; B31C 1/00

USPC ..... 493/270, 296, 152–155, 276; 220/737–739, 758, 592.24; D7/624.2; 229/4.5, 403

See application file for complete search history.

(56) References Cited

U.S. PATENT DOCUMENTS

| | | | | |
|---|---|---|---|---|
| 2,028,566 | A | | 1/1936 | Seipel |
| 5,205,473 | A | | 4/1993 | Coffin |
| 5,209,367 | A | | 5/1993 | Van Musscher |
| 5,425,497 | A | | 6/1995 | Sorensen |
| 5,660,326 | A | | 8/1997 | Varano |
| 6,273,333 | B1 | | 8/2001 | Ward |
| 6,286,754 | B1 | | 9/2001 | Loveland |
| 6,343,735 | B1 | | 2/2002 | Cai |
| 6,378,766 | B2 | | 4/2002 | Sadlier |
| D547,653 | S | | 7/2007 | Wong |
| D648,185 | S | * | 11/2011 | Sanders ..... D7/624.2 |
| D657,202 | S | | 4/2012 | Sanders |
| 8,146,797 | B2 | | 4/2012 | D'Amato |
| 2009/0272753 | A1 | * | 11/2009 | Rebelak et al. ..... 220/737 |
| 2009/0302047 | A1 | | 12/2009 | Anderson |
| 2010/0200603 | A1 | * | 8/2010 | Kim et al. ..... 220/739 |
| 2010/0200647 | A1 | | 8/2010 | Tedford |

OTHER PUBLICATIONS

Belleville Washer: http://en.wikipedia.org/wiki/Belleville_washer (accessed Jul. 10, 2013).

* cited by examiner

*Primary Examiner* — Gloria R Weeks
*Assistant Examiner* — Justin Citrin
(74) *Attorney, Agent, or Firm* — K Karel Lambert; Lambert Patent Services

(57) ABSTRACT

A sleeve for jacketing a container such as a beverage cup, where the sleeve is assembled by cutting and folding from a unitary flat panel, the sleeve having no outwardly projecting flaps or ridges. Inwardly folding flaps adapt themselves to the taper and diameter of the cup. Multiple layers of material thickness in the sleeve may be realized using the templates and folding methods of the invention, and the sleeve is printable on either or both sides so that decorative or commercial indicia may be displayed according to the end user's needs or wishes. The invention finds use in making printed insulative sleeves having logos and other customized indicia, and may be folded according to the methods of the invention by the supplier or by the user of the sleeve.

18 Claims, 22 Drawing Sheets

FOLDABLE CONTAINER SLEEVE

CROSS REFERENCE TO RELATED APPLICATIONS

This application claims priority to U.S. Provisional Patent Ser. No. 61/679,010 entitled "FOLDABLE CONTAINER SLEEVE" filed 2 Aug. 2012 which is herein incorporated, including the claims, in full for all purposes.

GOVERNMENT SUPPORT

None.

FIELD OF THE INVENTION

This invention generally relates to a sleeve for jacketing disposable frustroconical containers such as cups used for serving hot or cold drinks. The cup holder is cut and prescored or perforated from a unitary sheet, roll, or blank so as to be folded into a generally conical sleeve or jacket with inside-folded locking flaps.

BACKGROUND

Disposable paperboard cups and bowls find broad use in food service for containing hot or cold beverages. These articles are generally provided in one or more standardized sizes and are normally of a frustroconical shape that fits in the hand with upwardly open top. The rim is reinforced to retain its generally circular shape and may be adapted to receive an interlocking lid. Related food service containers include chili bowls, ice cream cones, Chinese take-out food boxes, hot dog wrappers, and even soda pop cans. Also of interest are seedling pots and biodegradable cups such as are used in the nursery business.

Most such container walls are generally thin, and in one popular application, jacketing sleeves have been used to add an insulative layer that protects the cup holder's hand from the heat of a beverage. Perhaps the earliest of these sleeves are described in U.S. Pat. Nos. 2,028,566 and 5,205,473. More recent improvements designed to be cut from sheetstock are typified by U.S. Pat. Nos. 5,209,367, 5,425,497 and 5,826,786. An arcuate circumferential band is cut and slotted or glued at opposing ends to form a tapered sleeve for receiving a cup (see also US Pat. Appl. No. 2006/0000882). The devices are generally limited to thicker insulative material such as corrugated cardboard, and would be expected to have little insulative utility if made from thinner printing paper or card stock such as can be run through a laser or inkjet printer. The devices thus find a market in offset printing and die cutting processes where large scale production results in economy of scale. While commercially successful, devices of this type are increasingly generic and unappreciated, and do not offer unique opportunities for personal expression or targeted advertising.

Expired U.S. Pat. No. 6,273,333 to Ward, hereinafter the '333 device, discloses a combination of coaster and cup holder having a lower surface that is insulated and which contacts the cup, an upper surface intended for gripping, and a central slit. In use, a sleeve is formed by folding the lower surface back upon itself and then the slit is opened to receive the cup. Two flaps are exposed on either side of the cup and include an inferior hinged fold that resists slippage of the cup through the slit. Stress relief orifices are formed at either end of the slit, reducing the capacity of the sleeve to stay on the cup. A related structure using external flaps with hinge is shown in FIG. 16 of U.S. Pat. No. 7,858,015. However, neither of these devices suggest a means to avoid the awkward presence of the externally exposed flaps, which can cause the user to knock over or drop the cup unless the sleeve is carefully gripped to avoid mishaps.

U.S. Pat. No. 6,343,735 to Cai, hereinafter the '735 device, is cut from a planar sheet according to a pattern, cut crosswise at the center, and then folded with flaps outwardly exposed. After gluing, the flaps form raised lateral ridges (termed "wings") that the inventor values as a hook for a removable cup lid and which are adapted to be grasped even when the cup itself is uncomfortably hot. The wings serve as a substitute for fold-out pressboard fingerhole handles known in the art. This again poses a disadvantage as was noted for the '333 device, i.e., the outwardly projecting ridges, tabs, wings, or handles can cause an unwary user to knock over or drop a drink, and require the user to carefully pick up the assembly with cup by the fingers, not by the hand, which is an invitation for accidents. Also, the folds of the sleeve must be carefully matched to the size and taper of the cup.

US Design Pat. No. D657202 to Sanders again depicts a foldable sheet having a hinge region formed of outwardly disposed tabs. Outwardly projecting tabs can cause the user to bump, bobble or lose grip on the cup, leading to spills and unpleasant near spills. These tabs also can interfere with raising the cup to one's mouth, and require that the user concentrate on how to grip the cup. This sleeve also may easily fall from the cup because the bottom of the sleeve does not contact the cup at the hinges. Perhaps not surprisingly, the products have been poorly received.

Thus, there is a need in the art for a container sleeve that overcomes the above disadvantages, that is economical in short run printing processes using sheetstock having a range of thicknesses, that enables building up insulation from multiple layers from thinner stock, that adapts its shape to fit cups ranging in size and taper, that permits double sided, reversible use, that is adapted for shaping customized borders around the sleeve, that permits home printing and small business uses for special events, that offers a choice of two reversible surfaces for displaying printed messages or graphics, and/or other advantages that will be apparent from the drawings and the accompanying disclosures herein. Also of interest are foldable pockets in the sleeve, such as are useful for inserting sugar or cane packets, or for inserting a folded napkin, advertising, instructions, messages, coupons, or the like, as would be carried inside the sleeve when in use, for example.

SUMMARY

This invention is related to a foldable sleeve for use with containers in need of a printable or insulative jacket. The sleeve generally fits over the outside walls of a container such as a cup at about the midline. In a representative embodiment, a cup is jacketed with a sleeve. The sleeves of the invention may be reversible, having two exterior faces for selection of advertising messages according to the target viewers. The sleeves may have two, three, four or more layers over part or most of the area of the sleeve, thus realizing an insulative value for sleeves made of thin and inexpensive paper, particularly when combined with embossing of the layers or other means to form air spaces between the fingers and the hot cup wall. Optionally, the sleeves may be pre-folded, may be glued for sale as pre-formed and ready to use implements, may be provided as a supply of precut templates to be folded by the user, or may be provided as pre-cut and scored, kiss-cut or perforated blanks suitable for subsequent printing. Advantageously, the templates may be printed in "short runs", without requiring extensive tooling and specialized machinery for high-volume production, and thus serve an unmet need in offering customized sleeves with unique branding and messaging that can be offered to small business and home users. In one instance, the panels are provided for use in home laser and inkjet printers.

In a preferred embodiment, the invention is a method for making a cup sleeve from a flat unitary panel of a foldable material, the sleeve having dimensions to jacket the sidewalls of a cup. Suitable cups, such as paper beverage cups, have an outside wall formed as an inverted cone with webbed conical frustrum, sealed base, and bottom rim on which the cup rests and a top rim having a circumference defining an opening for receiving a food or drink. The panel is configured to fold into a sleeve for insulating and displaying messages or other indicia on the outside of the cup where it is grasped by the user and has inwardly folding flaps which adapt the sleeve to the size and taper of the cup. In another aspect, inwardly folding flaps may be used to build up layers or to form pockets for carrying serving accessories, for example.

The method includes steps for: a) providing a two-sided panel, the panel having a top edge, a bottom edge, a right edge, a left edge, a right flap, a left flap, and a waistline extending from the right edge to the left edge and crossing the right flap and the left flap, the waistline defining an upper panel section above the waistline and a lower panel section below the waistline; wherein, i) the right flap is defined by an right upper flap foldline extending from a rightwardly disposed foldpoint on the top edge to a right waistpoint rightwardly disposed on the waistline, and a right lower flap foldline extending from a rightwardly disposed point on the bottom edge to the right waistpoint, and further wherein the right flap is partitioned between the upper panel section and the lower panel section by a right waist foldline extending from the right waistpoint to a lateral foldpoint on the right edge, the right waist foldline defining a right hinge member dividing the right flap into hingedly foldable upper and lower right flap partitions; ii) the left flap is defined by an left upper flap foldline extending from a leftwardly disposed foldpoint on the top edge to a left waistpoint leftwardly disposed on the waistline, and a left lower flap foldline extending from a leftwardly disposed point on the bottom edge to the left waistpoint, and further wherein the left flap is partitioned between the upper panel section and the lower panel section by a left waist foldline extending from the left waistpoint to a lateral foldpoint on the left edge, the left waist foldline defining a left hinge member dividing the left flap into hingedly foldable upper and lower left flap partitions; iii) the upper panel section and the lower panel section are divided by a slit through the panel, the slit extending from the right waistpoint to the left waistpoint and having a slit length less than an intermediate circumference of a beverage cup intended to be inserted into the slit and encircled therein (where "intermediate" indicates a circumference of a generally horizontal section taken at a height above the bottom rim of the cup but lower than the top rim); then b) folding the flaps on the right and left flap foldlines so that the flaps are folded inwardly onto the panel; c) hingedly folding the lower panel section over the upper panel section on the hinge members formed by the waistline foldlines and thereby locking the right and left flaps between the upper panel section and the lower panel section of the panel as folded; d) with slit downwardly disposed, opening a generally annular center passageway between the inside wall of the upper panel section and the inside wall of the lower panel section, thereby forming a sleeve with outside sleeve walls and inside sleeve walls; and, e) inserting the cup into the center passageway and through the slit until seated therein, thereby jacketing the cup and locking the right and left flaps between the inside sleeve walls and the outside circumference of the cup where gripped by a user. The panel may be provided and boxed in a pre-folded form as a ready-to-use sleeve, or may be folded by the end user at the place of use.

Surprisingly, by providing a template with right flap upper foldline and right flap lower foldline defining an obtuse angle ($\theta_1$) around the right waistpoint and left flap upper foldline and left flap lower foldline define an obtuse angle ($\theta_2$) around the left waistpoint, wherein $\theta_1$ and $\theta_2$ are generally equal and opposite, the panel is caused to cuppingly "flex" when folded on its upper and lower flap foldlines and then to "pop open" when folded on its hinge members, a benefit that is an advance in the art. Unexpectedly, by angling the hinge folds at an off angle from the waistline, the center passageway for receiving the cup opens spontaneously and the flaps are urged against the inside walls of the sleeve in the same motion, an advantage that is an advance in the art.

Advantageously, sleeves of the invention will fit cups having a range of diameters because the flaps adapt to the size and taper of the cup. Thus the sleeves need not be marketed for use with particular cups, and may be stocked by retailers and others for use with one or more cup sizes.

Other embodiments are described below. The foregoing and other elements, features, steps, and advantages of the invention will be more readily understood upon consideration of the following detailed description of the invention, taken in conjunction with the accompanying drawings, in which presently preferred embodiments of the invention are illustrated by way of example.

BRIEF DESCRIPTION OF THE DRAWINGS

The teachings of the present invention are more readily understood by considering the drawings, in which:

In FIG. 4A, the sleeve is viewed from the bottom.

FIG. 7A illustrates the use of corrugated stock in making folding sleeves of the invention. FIG. 7B illustrates use of embossment to increase the heat transfer resistance of folding sleeves of the invention. FIG. 7C depicts use of glue dots during printing, whereby sleeves are prefolded with glued flaps. FIG. 7D depicts use of hot glue during printing and assembly, whereby sleeves are prefolded with glued flaps.

Figure 1:
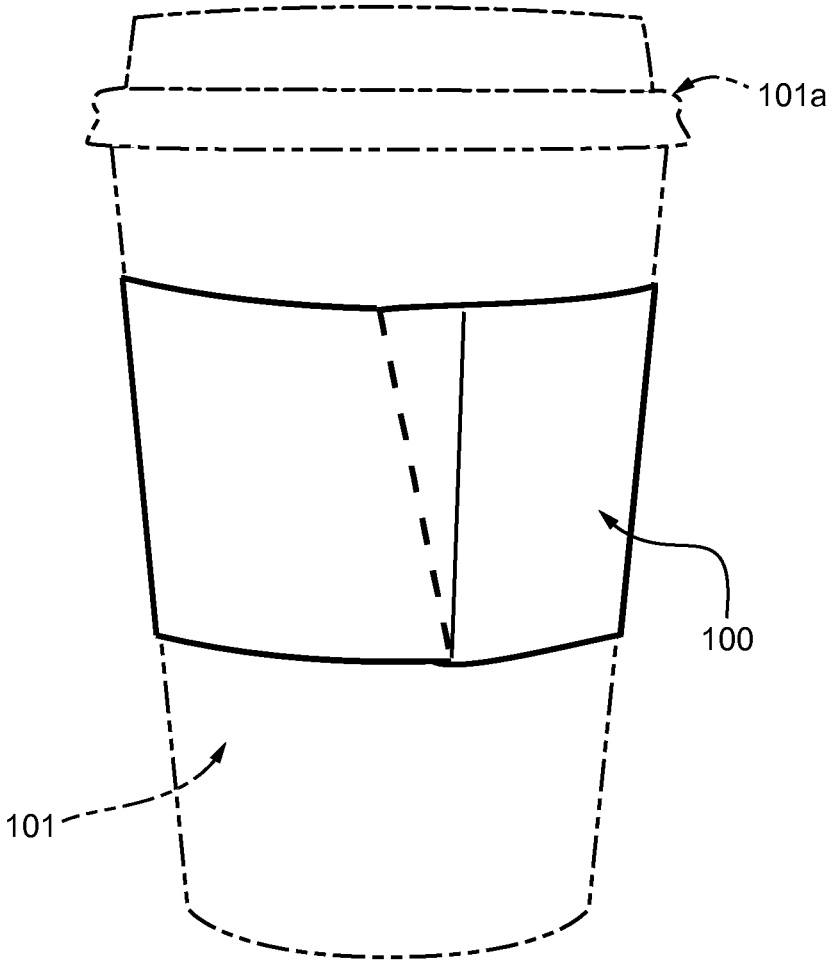
FIG. 1 is a rendering of a foldable sleeve in use around a beverage cup. Flaps are locked in place by folding.

The drawing figures are not necessarily to scale. Certain features or components herein may be shown in somewhat schematic form and some details of conventional elements may not be shown in the interest of clarity and conciseness. The drawing figures are hereby made part of the specification, written description and teachings disclosed herein. It is to be expressly understood, however, that the drawings are for illustration and description only and are not intended as a definition of the limits of the invention. The various elements, features, steps and combinations thereof that characterize aspects the invention are pointed out with particularity in the claims annexed to and forming part of this disclosure. The invention does not necessarily reside in any one of these aspects taken alone, but rather in the invention taken as a whole.

Notation and Nomenclature

Certain terms throughout the following description are used to refer to particular features, steps or components, and are used as terms of description and not of limitation. As one skilled in the art will appreciate, different persons may refer to the same feature, step or component by different names. Components, steps or features that differ in name but not in function or action are considered equivalent and not distinguishable, and may be substituted herein without departure from the invention. Certain meanings are defined here as intended by the inventors, i.e., they are intrinsic meanings Other words and phrases used here take their meaning as consistent with usage as would be apparent to one skilled in the relevant arts.

A "sheet" refers to a generally planar material having a front and a back surface separated by a thickness. Sheets may be formed of paper, cardboard, pressboard, cardstock, plastic, and so forth, and may include exploded intermediate layers such as corrugations, fibers or foam. The front and back surfaces are generally of a printable material, but are not limited thereto.

A "panel" refers to a unitary piece cut or stamped out of a sheet or roll, generally following a template. Certain templates are designed to be tessellated so as to maximize the number of panels per sheet or roll. When sheets or rolls are used, generally any printing operations are performed before the panels are cut from the substrate material. Typically embossing operations may be performed at the time the panels are cut or stamped.

"Cut", "slit" or "punch" operations refer to ways of making clean breaks that separate a sheet into two parts. A variety of blade, stamping and laser cutters may be used to cut slit or punch a sheet clear through.

"Perforation" as used here, relates to a practice of punching, piercing, stamping or cutting a linear row of holes or slits through a panel so as to weaken the sheet for folding. A variety of blade, stamping and laser cutters may be used to perforate a sheet in this way. Perforation may be advantageous if folds are to be bidirectionally inward or outward. However, excessive weakening can be detrimental to the strength of the fold if insufficient material is left along the perforation line, so perforation is generally used with restraint.

"Kiss cut" refers to a cut through a partial thickness of the panel, as may be used in directional folding for cleaner fold lines. As depicted here, perforated and/or kiss cut foldlines are generally indicated in the drawings by a dashed line on a panel.

"Scoring" and "creasing" are used interchangeably to indicate a weakening of a sheet at a specific fold line in ways that do not involve perforation. Scoring for example can involve a rotary scoring wheel that creases a sheet; creasing can involve a platen press or roller having male ridges on one surface and mating female grooves on a second surface, for example, such that the sheet is pressed between the surfaces so as to crease the sheet according to the layout of the ridges and grooves. Hence creasing can refer to any process known in the art for preparing a sheet for folding at a fold line by weakening the sheet along the line without perforating the sheet. As depicted there, creased or scored foldlines are generally indicated by light solid lines on a panel.

The creased, kiss cut, scored or perforated line need not be straight, but may be arcuately curved in some applications. Some fold lines may be both perforated and creased if desired. Certain methods and combinations of methods for creasing and scoring result in fold lines that more readily can be folded in either direction; some methods result in fold lines that are preferentially weakened for folding in a single direction.

Creasing may also result from pre-folding, and may be advantageous because the material will remember the established folding direction, as in a pleat. A fold line may be creased so that one side or the other of the sheet or panel may be contacted against itself.

"Flap" is a flat, usually thin piece attached at only one side or edge, which projects from a larger sheet and is intended to be folded over.

"Cup" refers to a container having an outside wall formed as an inverted cone with webbed conical frustrum and bottom rim on which the cup rests and with top rim having a circumference defining an opening for receiving a food or beverage. Cups are representative of a broader class of containers or vessels that includes bowls and other shapes. The "intermediate circumference" of a cup or vessel refers to a circumference of a generally horizontal or transverse section taken at a height above the bottom rim of the cup but lower than the top rim.

For purposes of this publication, a "user" is generally the end user (i.e., the ultimate consumer) of the sleeves of the invention, which may be disposable such as when used with paper cups for hot beverages, for example. A supplier refers to a manufacturer, wholesaler, distributor, or retailer. Supplying a sleeve, particularly when bulk quantities are involved, generally indicates an act of manufacturing, distributing, or retailing, such as by making quantities of the sleeves for a customer, while not limited thereto.

"Oblique" indicates an orientation in a slanting angle or direction relative to horizontal or perpendicular; and thus is a relative term.

"Obtuse" is a term of geometry referring to an angle that is less than 180 degrees and greater than 90 degrees.

General connection terms including, but not limited to "connected," "attached," and "affixed" are not meant to be limiting and structures so "associated" may have other ways of being associated.

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom," and the term "inside" is meant to be relative to the term "outside," and so forth. The term "waistline" is also a relative term, indicating a generally equatorial midline separating the top edge from the bottom edge of a panel, but is not limited to a straight line, and thus can be considered a zone or belt region useful in locating the partition between the upper panel section and the lower panel section and the hinge members that join the sections.

Unless specifically stated otherwise, the terms "first," "second," "third," and "fourth" are meant solely for purposes of designation and not for order or limitation.

Reference to "one embodiment," "an embodiment," or an "aspect," means that a particular feature, structure, step, combination or characteristic described in connection with the embodiment or aspect is included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments. The invention is not limited to preferred embodiments.

It should be noted that the terms "may," "can," and "might" are used to indicate alternatives and optional features and only should be construed as a limitation if specifically included in the claims. It should be noted that the various components, features, steps, or embodiments thereof are all "preferred" whether or not it is specifically indicated. Claims not including a specific limitation should not be construed to include that limitation. The term "a" or "an" as used in the claims does not exclude a plurality.

It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the term "includes" means "comprises" (e.g. a device that includes or comprises A and B contains A and B but optionally may contain C or additional components other than A and B). It should be noted that, unless otherwise specified, the singular forms "a," "an," and "the" refer to one or more than one, unless the context clearly dictates otherwise.

"Conventional"—refers to a term or method designating that which is known and commonly understood in the technology to which this invention relates.

Unless the context requires otherwise, throughout the specification and claims that follow, the term "comprise" and variations thereof, such as, "comprises" and "comprising" are to be construed in an open, inclusive sense that is as "including, but not limited to."

The appended claims are not to be interpreted as including means-plus-function limitations, unless such a limitation is explicitly recited in a given claim using the phrase "means for."

A "method" as disclosed herein refers one or more steps or actions for achieving the described end. Unless a specific order of steps or actions is required for proper operation of the embodiment, the order and/or use of specific steps and/or actions may be modified without departing from the scope of the present invention.

DETAILED DESCRIPTION

Referring now to the drawings, illustrated are one or more devices and methods of the invention, which demonstrate the inventive concepts embodied therein. Accordingly, the invention is not limited to any particular embodiment, feature or combination of features of the drawings.

FIG. 1 is a rendering of a foldable sleeve 100 in use around a beverage cup 101. Flaps are locked in place during folding and do not project from the sleeve. While a beverage cup is chosen to illustrate the concepts of the invention, the invention is not limited to beverage cups, and may be employed with a variety of containers, although is particularly well adapted for vessels having a generally conical shape and tapering from top to bottom. Beverage cups 101 of this kind are typically supplied with a lid 101*a*, which snaps over a reinforcing lip forming the top edge of the cup.

Figure 2A:
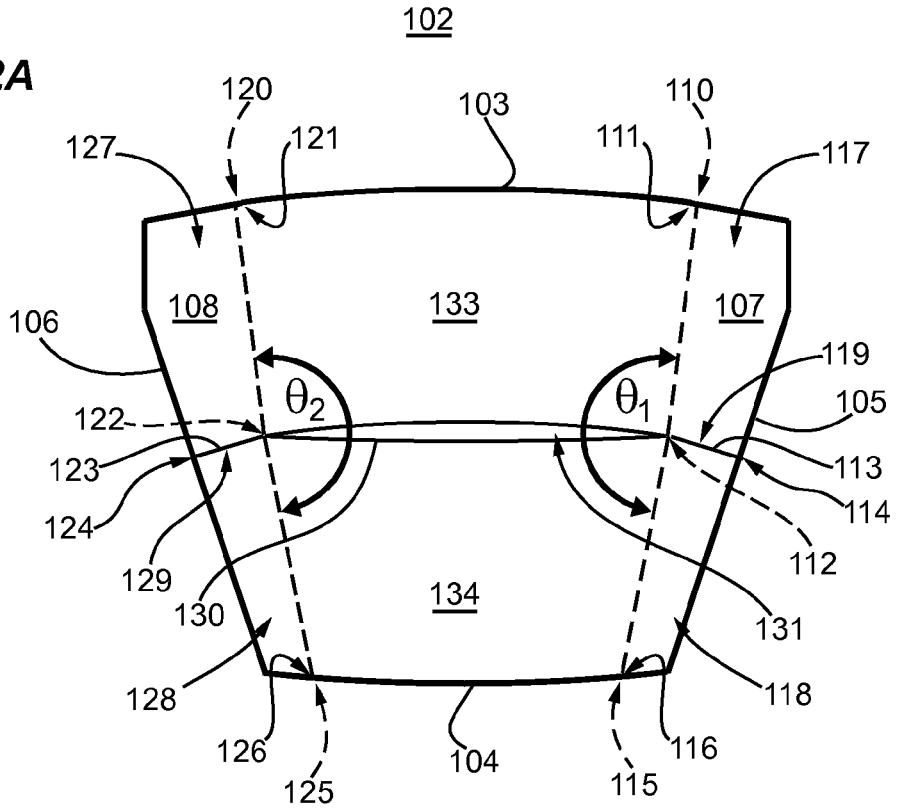
FIGS. 2A through 2H illustrate a method of folding a sleeve so that the sleeve encloses and locks the flaps and the hinge member.

FIGS. 2A through 2H illustrate a method of folding a sleeve 100 so that the sleeve encloses any flaps and hinge members formed in the folding process. In FIG. 2A, the layout of a flat two-sided panel 102 suitable for folding is described. Each panel is made of a foldable material and is dimensioned to form a sleeve for jacketing a cup when folded. These panels may be provided as blanks ready for folding or as prefolded assemblies ready for use. For added strength, each flap may be glued in place during folding, although this is not necessary for most applications. Panels may be made from sheets or rolls of stock materials. Materials include both thin materials and thicker materials, and include for example paper, cardstock, or plastic depending on the expected use.

Each panel is provided with a top edge 103 and a bottom edge 104, a right edge 105 and a left edge 106, a right flap 107 and a left flap 108. The precise cut and curvature of the edges may be varied for example as a decorative feature, or to match circumference lines of the cup on which the sleeve will be seated. Thus the top and bottom edges may comprise a generally arcuate contour, or may include projecting tabs formed to accommodate larger graphics printed on the exterior surfaces.

The right flap 107 is defined by a right upper flap foldline 110 extending from a rightwardly disposed foldpoint 111 on the top edge 103 to a right waistpoint 112 on a waistline dividing the panel into a upper panel section 133 and a lower panel section 134, and a right lower flap foldline 115 extending from a rightwardly disposed foldpoint 116 on the bottom edge 104 to the right waistpoint 112. The right flap is transected by a right waist foldline 113 extending from the right waistpoint 112 to a lateral foldpoint 114 on the right edge. The right waist foldline 119 divides the right flap into upper and lower right flap partitions (117, 118) joined by a right hinge member 119 articulated by the right waist foldline 113. A full-thickness slit 130 extending from said right waistpoint 112 to the left waistpoint 122 divides the panel into upper panel section 133 and lower panel section 134. The slit may be expanded to form cutout 131 if desired by removing or punching out additional material, as in a die stamping operation. The removed material is generally termed a "knockout", and is formed to accommodate the curvature of the outside circumference of the cup, as will be described below.

The upper and lower flap foldlines converge on the waistpoints (112, 122). In a preferred embodiment, the angle of convergence ($\theta_1$, $\theta_2$) is obtuse, i.e., not generally 180 degrees, which advantageously causes the sheet to spontaneously flex or "cup" in the process of folding, as will be described in more detail below. The obtuse angle at the right waistpoint (double arrow, $\theta_1$) and the obtuse angle at the left waistpoint (double arrow, $\theta_2$), are generally equal and opposite.

Figure 2B:
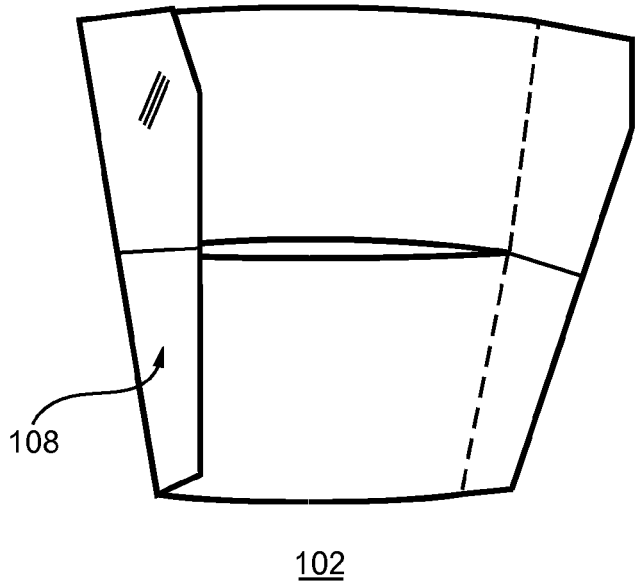
Figure 2C:
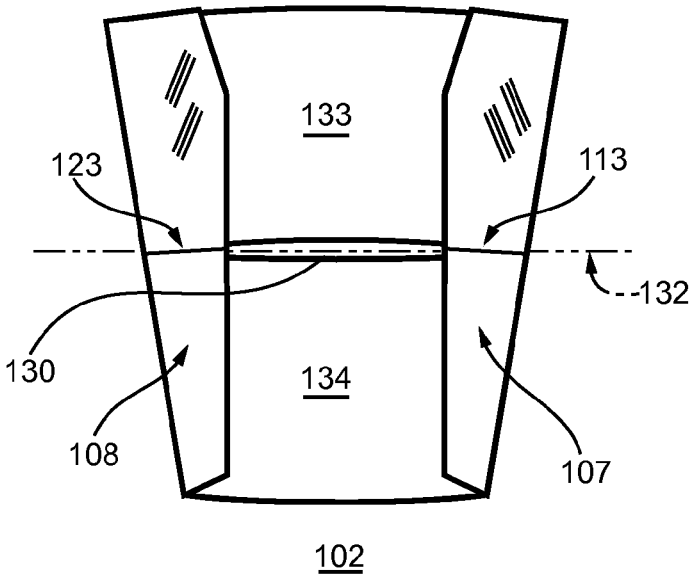

In a first step, folding begins with the flaps (107, 108). As shown in FIG. 2B, a first flap 108 is folded against the exposed surface of the panel. In FIG. 2C, a second flap 107 is folded symmetrically. Both flaps are folded on the right and left flap foldlines so that said flaps are folded inwardly.

The surface of the panel contacting the flaps as folded will become the inside wall of the sleeve. However, the direction of folding may be reversed by flipping over the panel before starting. Advantageously, this permits the user to choose which of two commercial messages or other printed or embossed indicia are displayed outwardly on the cup by orienting the panel as desired before making the first folds.

Figure 2D:
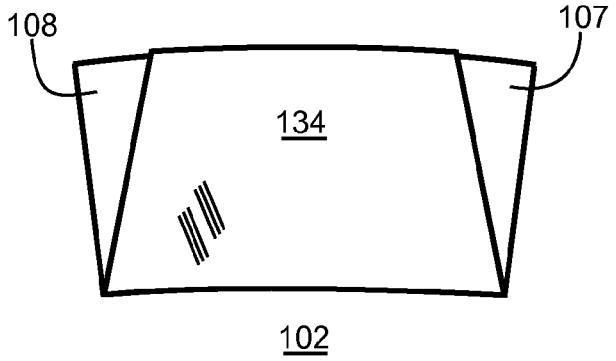
Figure 2E:
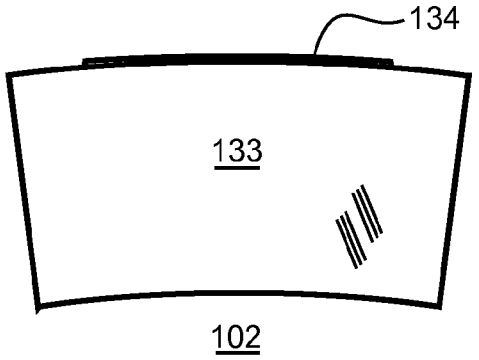

In a second step, the panel is hingedly folded on the waistline foldlines (113, 123), so that the lower section or member is folded on top of the upper section or member as shown in FIG. 2D. The flaps (107,108) that were in the first step folded inwardly now become locked between the upper panel section and the lower panel section of the panel when folded in this way, and are thus not exposed so as to cause accidents or to interfere with drinking from the lip of the cup. In this position, slit 130 and waist foldlines (113, 123) define what is termed the "waistline" (dotted line, 132) of the panel, which divides the upper member or section 133 from lower member or section 134 of the panel. FIG. 2E depicts the folded sleeve on its reverse face (flipped over) relative to the preceding figure, i.e., the sleeve has been inverted so that it can be viewed from behind. The outside surface of the upper segment 133 and the lower segment 134 of the sleeve provide prime areas for displaying a printed message.

Advantageously, if the panel had been inverted before the folding operation commenced, the opposite side of the panel would be displayed on the outside wall of the sleeve. By pre-printing two sides of a panel, the folding operation determines which of the two printed surfaces is displayed.

Figure 2F:
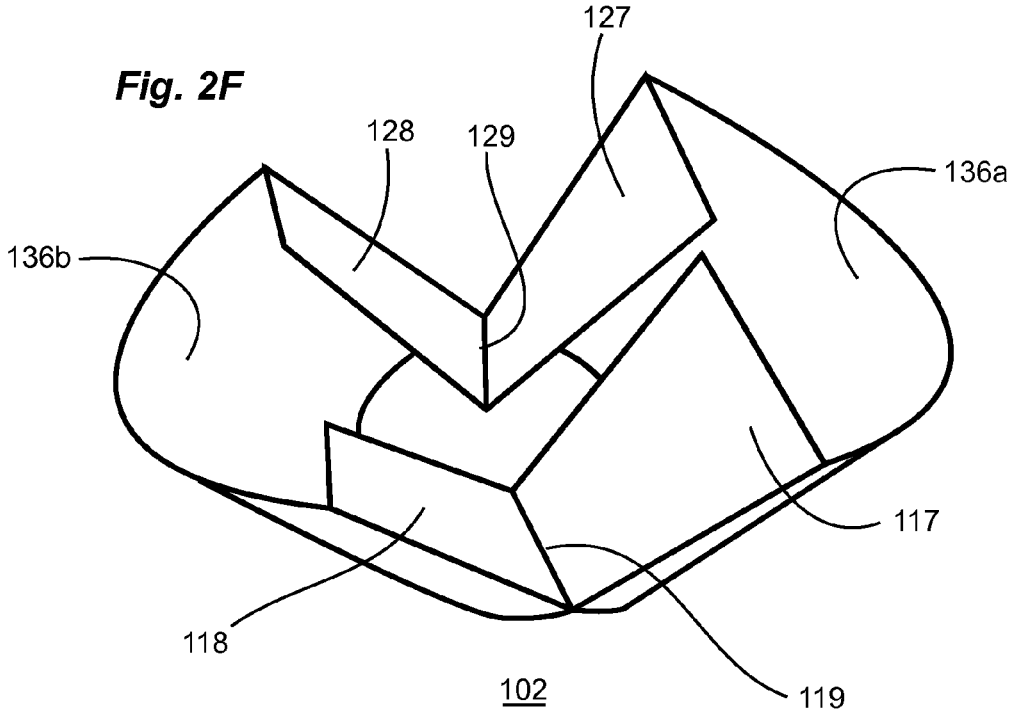
Figure 2G:
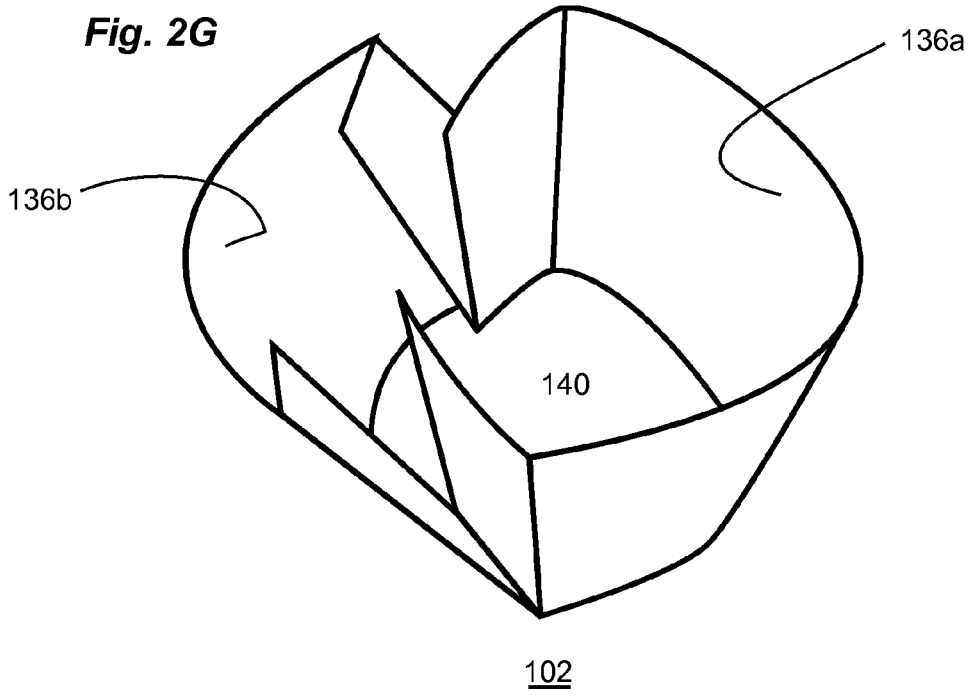

FIGS. 2F and 2G depict the action of the flap upper and lower right (117, 118) and left (127, 128) partitions during folding on the hinges. Each flap includes a hinge member (119, 129). Surprisingly, because of the obtuse angle of the upper and lower flap foldlines, and the oblique angle of the waistline foldlines (which are generally scored or creased at a perpendicular to the upper flap foldlines), the sleeve will spontaneously "flex" or "cup" by the folding process of step 2, and simultaneously the flaps are driven against the inside wall 136*b* of the lower panel section of the panel. The angularity of the hinge foldlines determines the directionality of the flap motion relative to the inside walls.

Figure 2H:
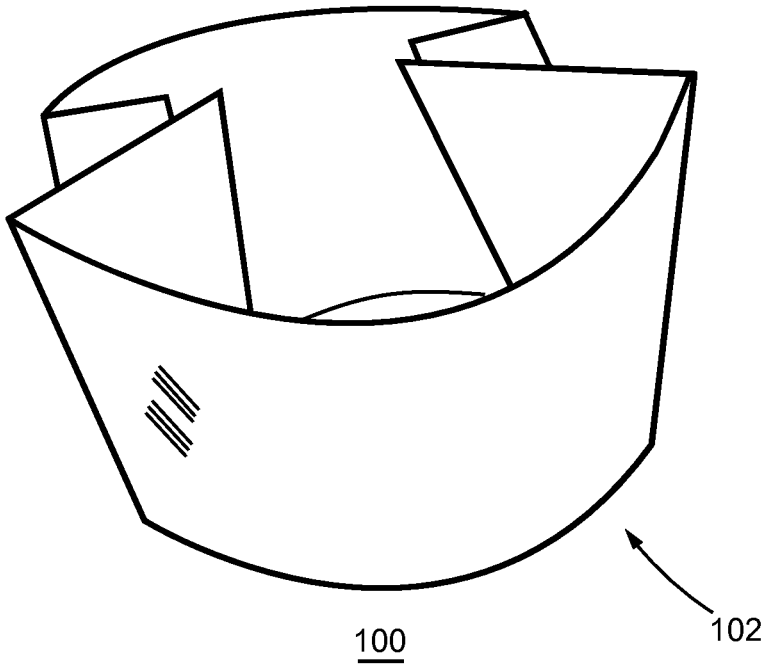

In this way, in a third step of the folding process, an annulus or central passageway 140 begins to open between the inside wall of the upper panel section of the panel 136*a* and the flaps. Formation of this annulus is facilitated by squeezing the outside right and left edges to "pop" the sleeve open. With slit downwardly disposed, a generally annular center passageway is opened between an inside wall 136*a* of the upper panel section and an inside wall 136*b* of the bottom part, thereby forming a sleeve with outside sleeve walls. The completed assembly is shown in FIG. 2H.

Figure 3A:
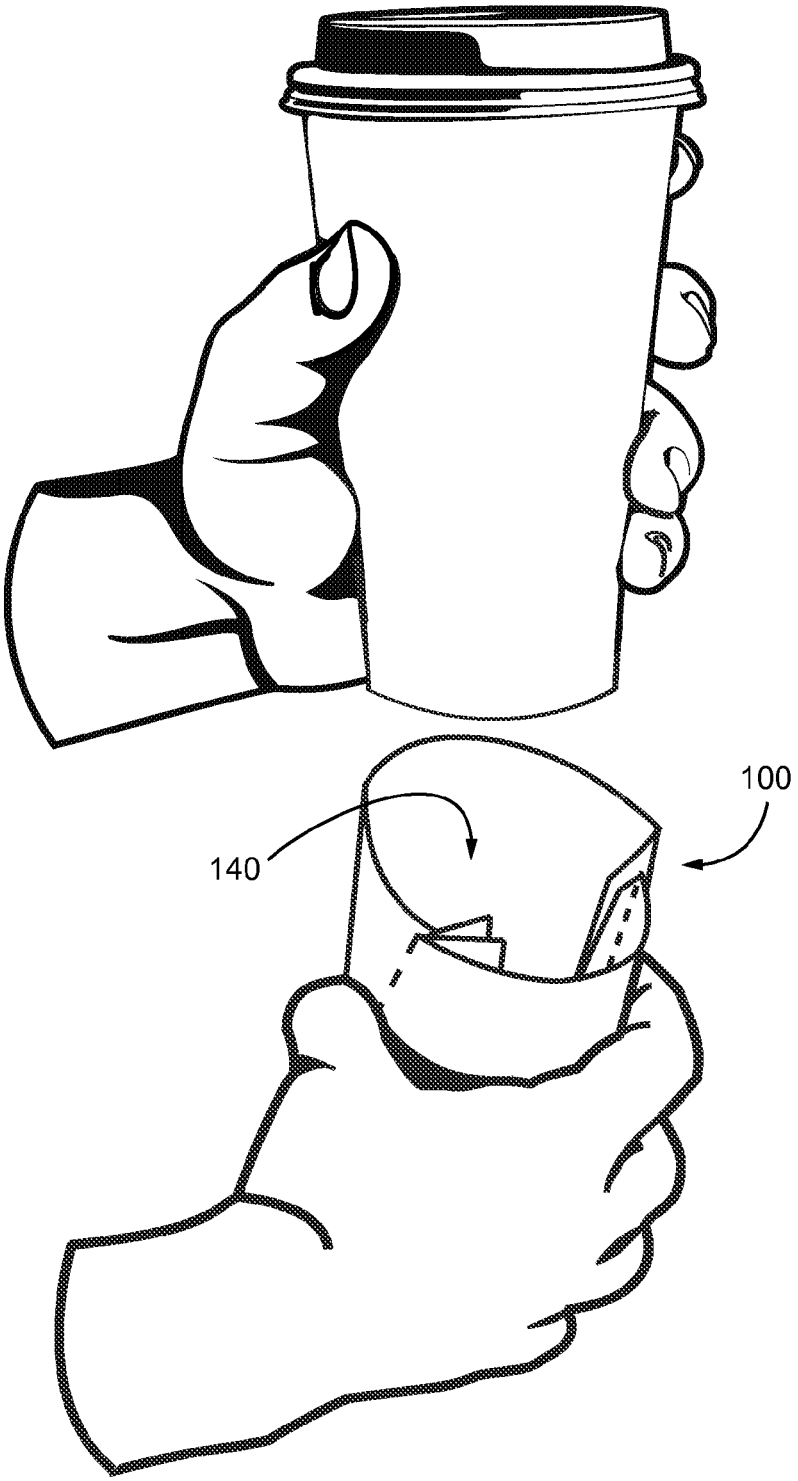
FIG. 3A graphically illustrates a step for inserting a beverage cup into a sleeve of the invention.
Figure 3B:
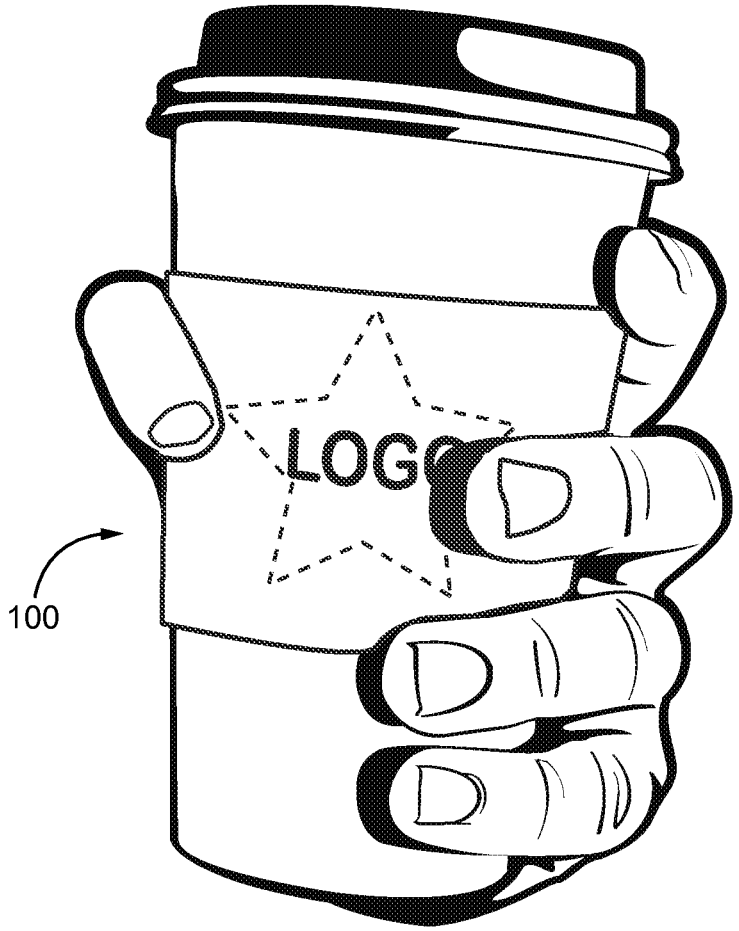
FIG. 3B is a graphical view of a sleeve/cup assembly ready for use.

In a final step, as depicted in FIGS. 3A and 3B, the user inserts a cup into the center passageway and through the slit until frictionally seated and secured. The slit length determines where the sleeve will seat on the cup outside wall. The sleeve jackets the cup and locks the flaps between the inside walls of the sleeve and the outside wall of the cup. FIG. 3B demonstrates that the fully assembled sleeve fits snugly on a standard beverage cup and is free of any projecting tabs, flaps, ridges or wings.

There is an unexpected and advantageous action that occurs in the second step (FIG. 2D above). As the two halves of the panel are folded along the waistline, the two members 133 and 134 "flex" and "pop" so that the sleeve automatically cups open and the flaps bend out of the way, aiding in insertion of the beverage cup into the sleeve. This kind of action can be better appreciated by comparing the action of a Belleville washer—which is topologically stressed when flexed, and spontaneously redistributes strains so as to "snap" to a more relaxed, alternate topology when stressed beyond a flexural limit. Similar dual-action stress relief is observed in the inventive templates, where the sleeve spontaneously forms itself and opens as the panel is folded at the waist. The off-angle hinge folds may be conceptualized as a center section through a Belleville washer, for example. The degree of stress relief is directly related to the oblique angles of the hinge fold lines and the upper and lower segments of the flap fold lines. This "flex and pop-open" action benefits the user in guiding the sleeve into a form suitable for receiving the cup.

Figure 4A:
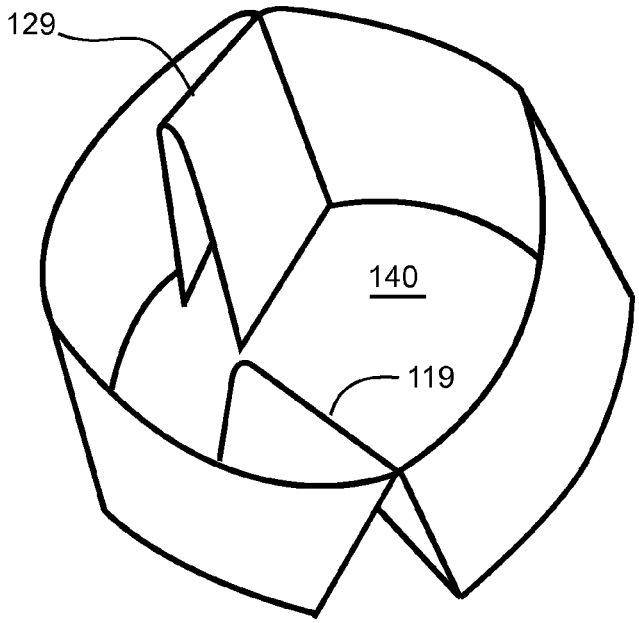
FIGS. 4A and 4B are perspective views of a folded sleeve of the invention, showing the sleeve as folded before use and the sleeve in its position of use around a frustroconical cup.

FIG. 4A depicts a bottom view of the folded sleeve with internal aperture 140. The hinge members (119, 129) are prominently displayed in this figure. Although perforated seams are preferred for the flap foldlines, the hinge region may require additional strength to engirdle the cup securely during carrying, so it has been found that the hinge foldline may preferentially be strengthened by creasing or kiss cutting rather than perforating the waist in this area. When the waist foldline is creased at an oblique angle to the waist 132, not only are the flaps forced against the inside wall of the sleeve as the sleeve is opened, but in the final assembly, the hinge tends to neatly align with the bottom edge of the sleeve. For comparison to FIG. 4A, a crown (top) view of a folded sleeve is shown in FIG. 2H.

Figure 4B:
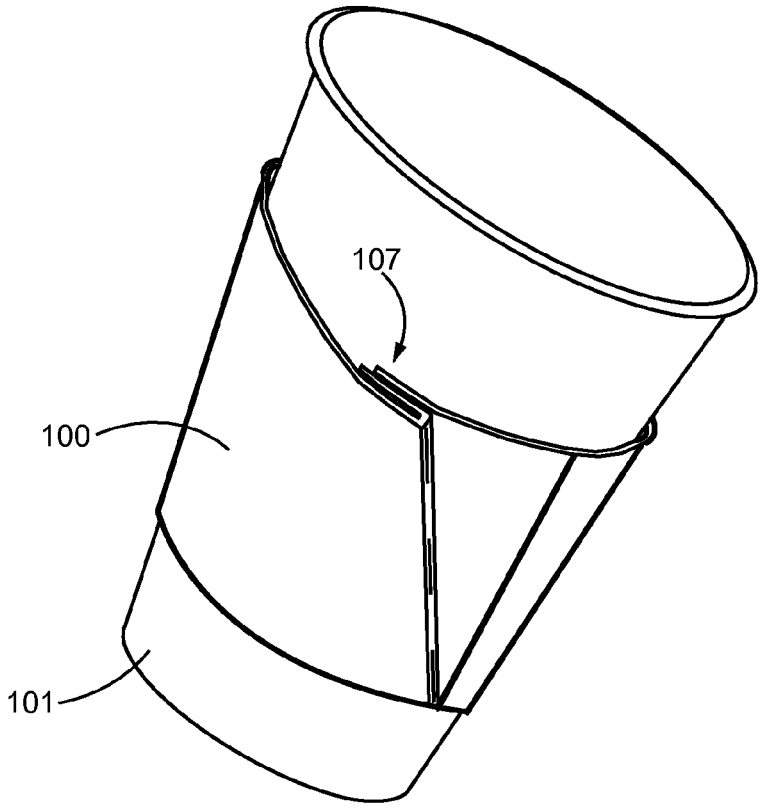

FIG. 4B depicts the upper rim of the sleeve 100 when in place around a cup 101. Folding the template as described above results in locking the flaps 107 under the outside layer of the sleeve, forming a smooth external band. The hinge and flap area is typically three layers thick, and is more insulative than areas of the sleeve that are only one layer thick.

Figure 5A:
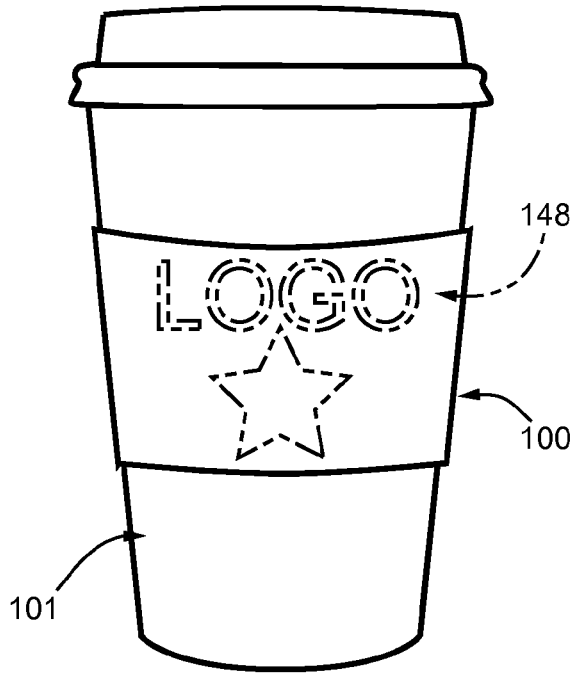
FIGS. 5A and 5B illustrate a first external surface of the reversible printing surfaces available on folded sleeves of the invention.
Figure 5B:
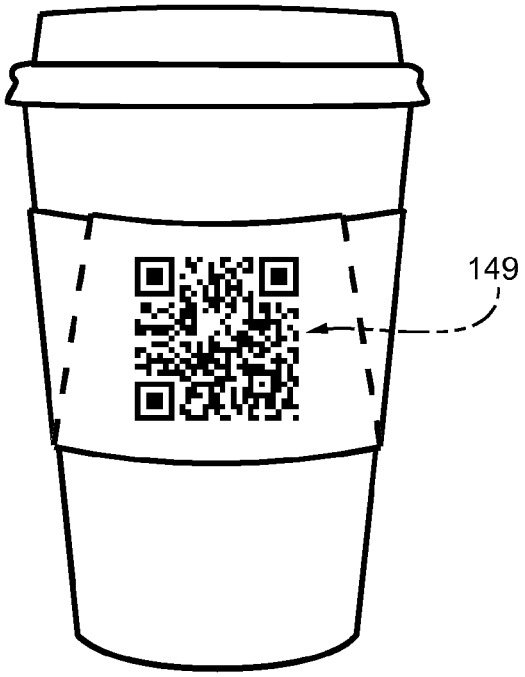

FIG. 5A depicts a frontal view of a fully assembled cup 101 with imprinted sleeve 100 having a logo 148 and decorative features. FIG. 5B depicts a rear view of the same sleeve, shown here with a QR mark that the user can scan to access an internet site. Similarly barcodes and other commercial information may be prionted on the sleeves.

FIGS. 5A and 5B illustrate reversible printing surfaces available on folded sleeves of the invention. Both portions (148, 149) of the exposed exterior surfaces are well adapted for displaying a printed message, and as described above, the folding method may be performed using either side of the panel as the exterior side, so that the final sleeve may be printed on either or both sides and may reversibly or selectably display one of two alternated graphical or advertising indicia.

Figure 6:
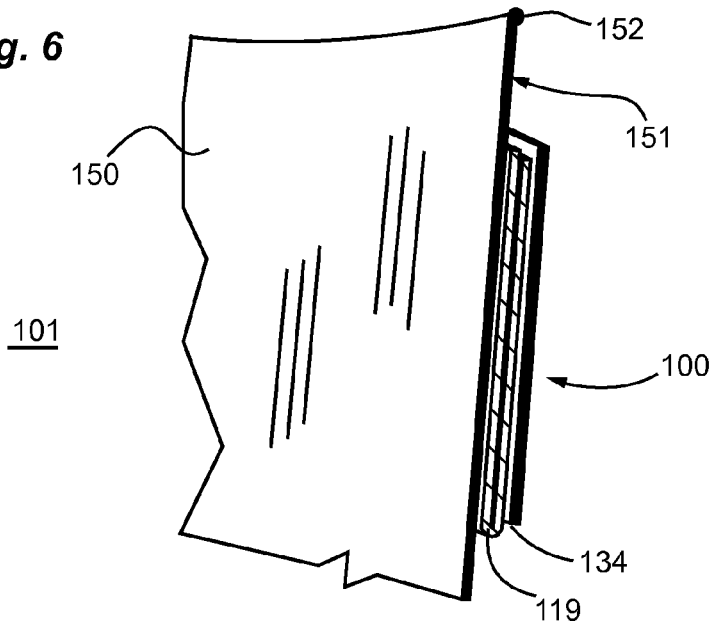
FIG. 6 is a cross-sectional view through a cup jacketed by a sleeve, showing three overlapping layers of the folding sleeve in the hinge region.

FIG. 6 is a view through a cup 101 jacketed by a sleeve 100 in cross-section, showing three overlapping layers of the folding sleeve in the hinge region 119, including an exterior layer 134. The cup includes an inside wall 150, an outside wall 151, and reinforced lip 152. The hinged region 119, which corresponds to the folded flap, is shown to be locked between the outside wall 151 of the cup and the outer panel layer 134 of the sleeve.

Figure 7A:
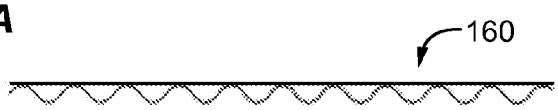
FIGS. 7A through 7D describe alternate construction details.
Figure 7B:
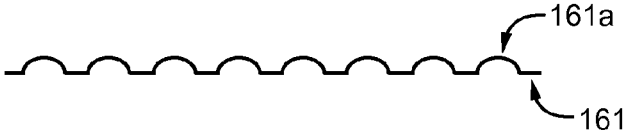
Figure 7C:
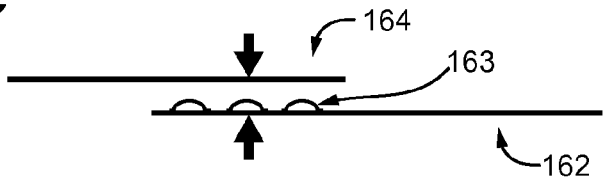
Figure 7D:
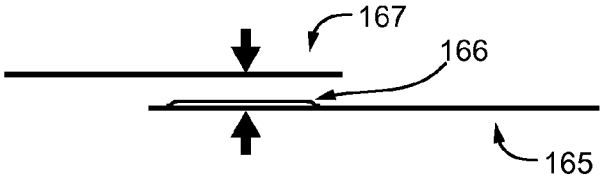

FIGS. 7A through 7D describe alternate materials and details of construction. FIG. 7A illustrates the use of a corrugated stock 160 in making folding sleeves of the invention. FIG. 7B illustrates use of embossment to increase the heat transfer resistance of folding sleeves of the invention. Embossed areas 161*a* are formed in a thin sheet 161 and are useful for increasing the insulation value of the sleeve. FIG. 7C depicts use of glue dots during printing, whereby sleeves are prefolded with glue 163 on the flaps (162, 164) and pressed together to bond. FIG. 7D depicts use of hot glue 166 applied during the printing and assembly process, whereby sleeves are prefolded with glued flaps, flaps (165, 167) are glued together, and the sleeves are boxed for bulk sale. Automated gluing machines suitable for use are supplied by B&R MOLL, Inc. of Ivyland, Pa. Double sided tape may also be applied selectively to the flap faces.

Embossing the surfaces also aids in frictionally gripping the cup surface and provides a pleasant tactile feel and non-slip grip. Non-skid coatings may also be applied, such as silicone rubber to enhance the cup-to-sleeve adhesion if desired. Layers of high density polyethylene (HDPE), low density polyethylene (LDPE), polypropylene, polyolefins, or expanded foams may also be applied as laminates if desired, the layers having improved insulative properties while presenting a printable surface thereon.

As each panel is printed and then diecut, the flaps and waistline folds may be machine formed, optionally with glue applied to or printed on contacting flap surfaces so as to permanently bond the sleeves in their fully assembled form. Prefolded sleeves, either glued or unglued are then stacked before being sold in boxes. Alternatively, the panels may be provided in unfolded form, and the user may complete the assembly by following a simple set of instructions.

Figure 8:
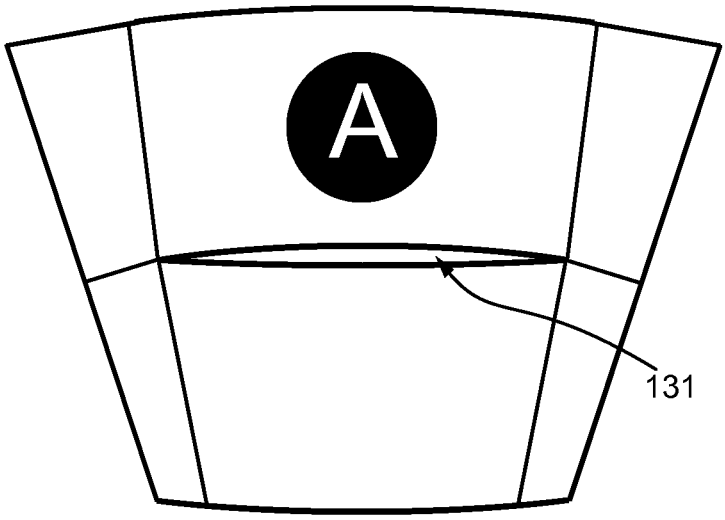
FIG. 8 is a template, as would be printed and cut from a planar sheet, for a basic sleeve of the invention. The sleeve is scored on fold lines and features an internal knockout on the waistline fold line.

FIG. 8 is a template, as would be printed and cut from a planar sheet, for a basic sleeve of the invention. The sleeve is scored on fold lines (solid lines) and features an internal knockout 131 on the waistline fold line.

Figure 9:
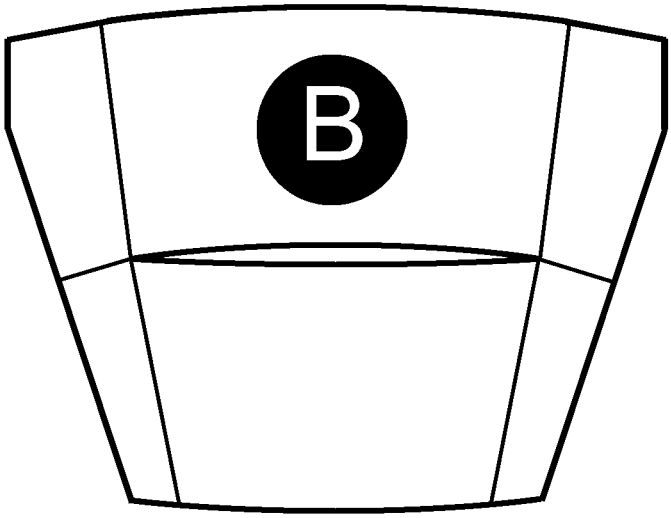
FIG. 9 is a template, as would be printed and cut from a planar sheet, for a basic sleeve of the invention. Lateral flaps are trimmed.

FIG. 9 is a template, as would be printed and cut from a planar sheet, for a basic sleeve of the invention. Lateral flaps are trimmed to relieve interferences during folding.

Figure 10:
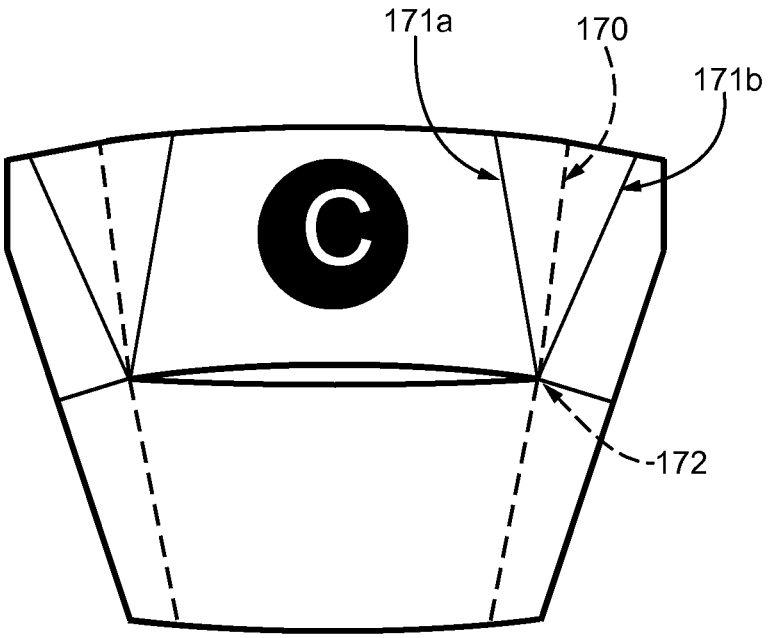
FIG. 10 depicts a template of an embodiment having trimmed lateral tabs and perforations on the flap fold lines. Also shown are scored fold or relaxation lines intersection at the waist.

FIG. 10 depicts a template of an embodiment having trimmed lateral tabs and perforations on the flap fold lines (170). Also shown are scored fold or relaxation lines (171*a*, 171*b*) intersecting at the waistpoint 172. Additional scoring improves the easy of fitting the sleeve to the cup by providing additional flexibility.

Figure 11:
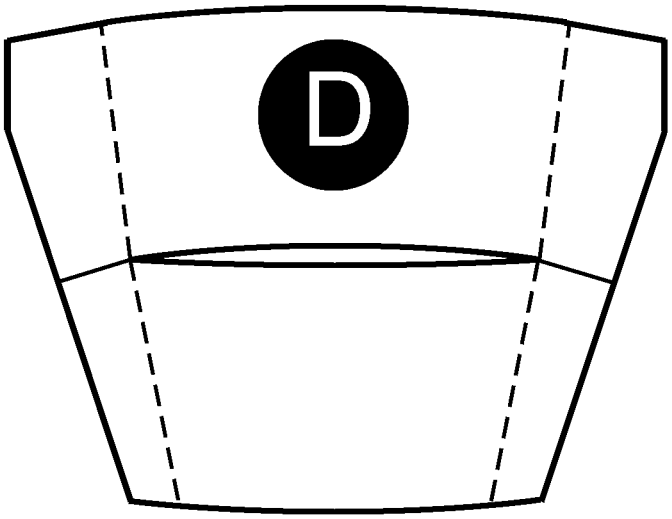
FIG. 11 shows a template that has been perforated at the flap and creased at the waist fold lines.

FIG. 11 shows a template that has been perforated at the flap foldline (broken lines) and creased at the waist foldlines (solid lines).

Figure 12:
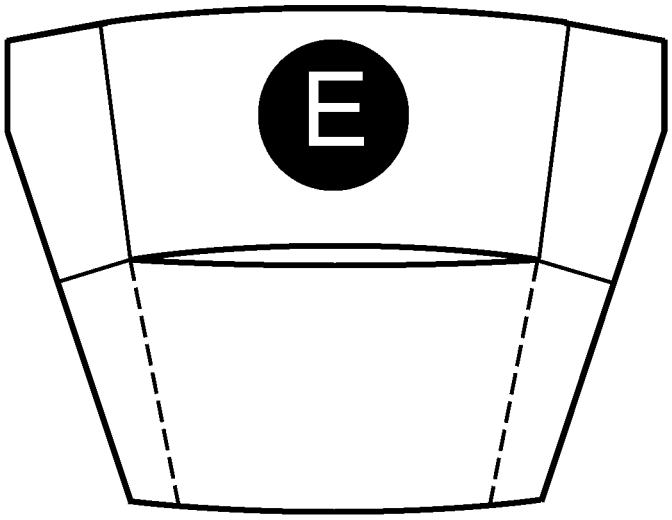
FIG. 12 describes an embodiment having mixed perforations and scoring around a waistline knockout.

FIG. 12 describes an embodiment having mixed perforations and scoring around a waistline knockout. Kiss cuts may also be used when folding is directional and can impart a cleaner product appearance.

Figure 13:
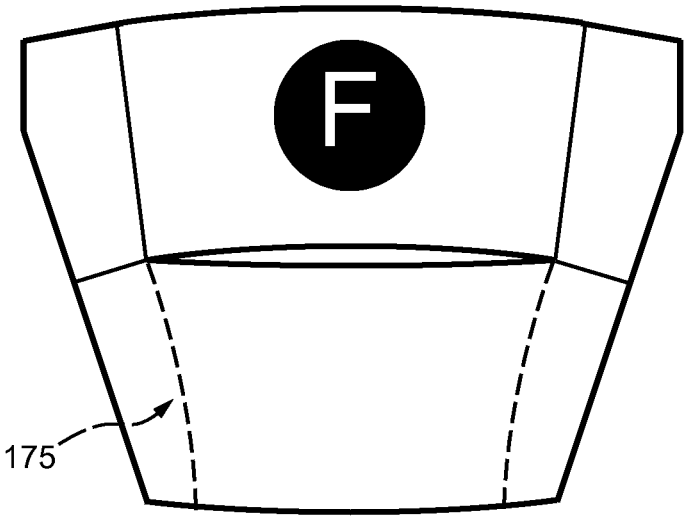
FIG. 13 describes an embodiment in which the flap fold lines are arcuate at the bottom half of the flaps.

FIG. 13 describes an embodiment in which flap foldlines 175 are arcuate at the bottom half of the flaps. This improves the folding process by controlling the release of topological stress (referencing discussion of Belleville washers above), and gives a better fit.

Figure 14:
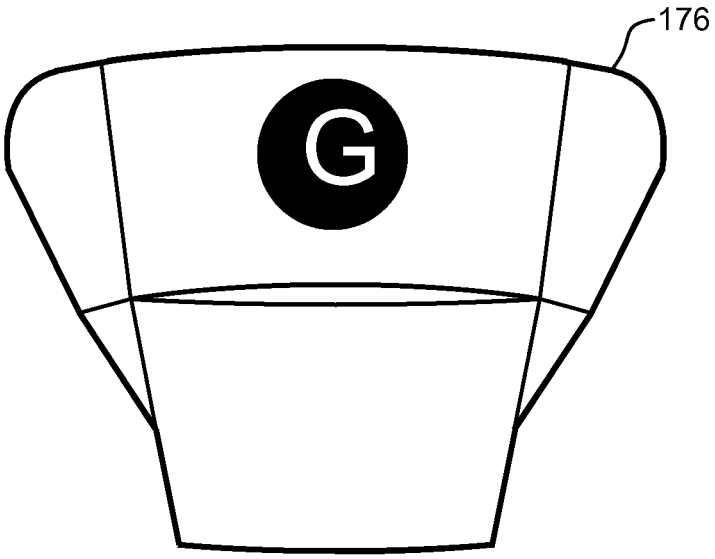
FIG. 14 is a template having a modified outline.

FIG. 14 is a template having a modified outline. The edges 176 may be laser or die cut with a decorative pattern adapted for printed material displayed on the exposed surfaces.

Figure 15:
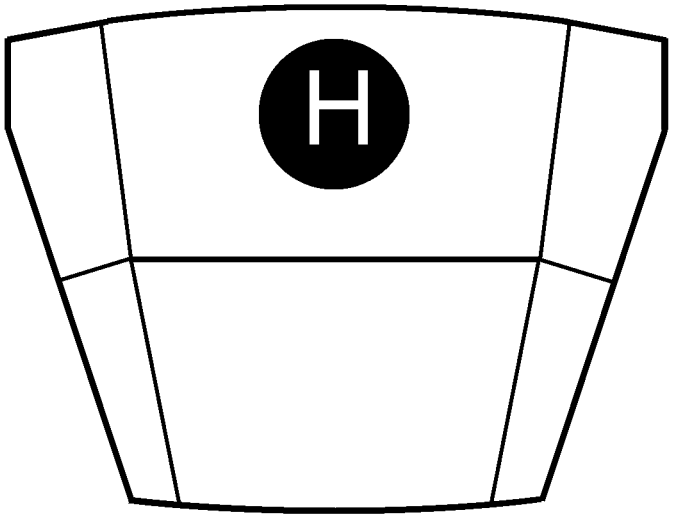
FIG. 15 is a template in which the waistline is slit and no knockout tab is cut.
Figure 16:
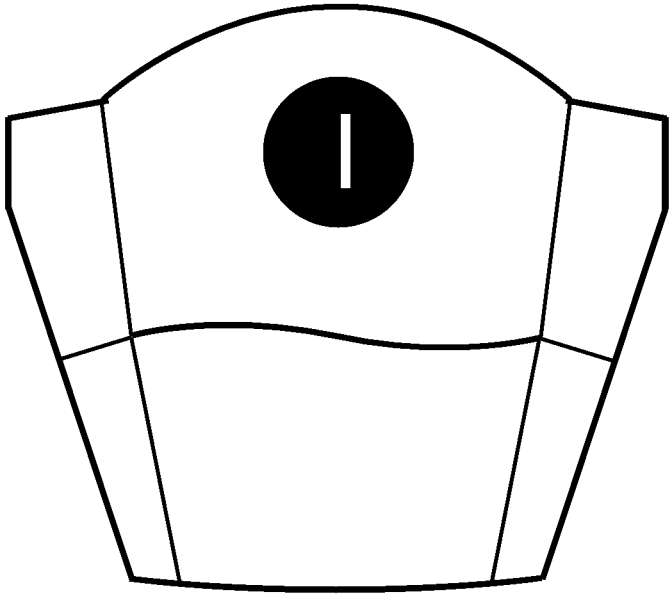
FIG. 16 illustrates that the waistline cut need not be straight.

FIG. 15 is a template in which the waistline slit is linear and no knockout tab is cut. FIG. 16 illustrates that the waistline slit need not be straight.

Figure 17:
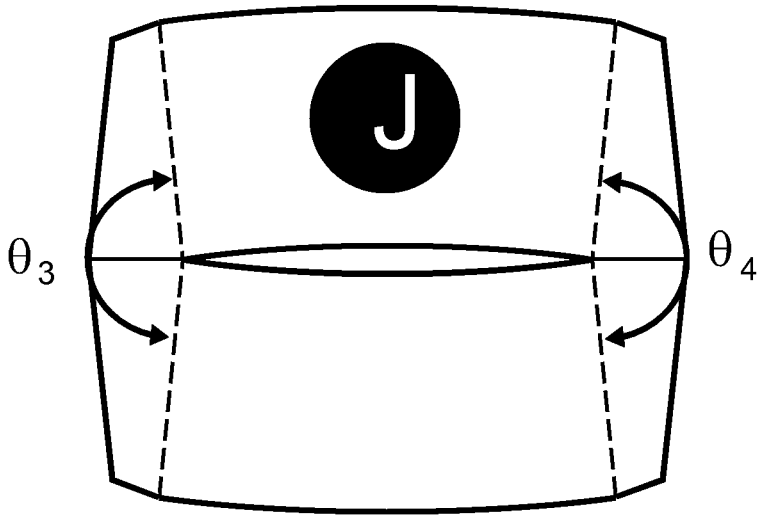
FIG. 17 includes trimmed down lateral flaps and a prominent waistline knockout.

FIG. 17 includes trimmed down lateral flaps and a prominent waistline knockout. The obtuse angles ($\theta_3$, $\theta_4$) of the right and left upper and lower flap foldlines are measured on the outside of the waistpoints, but surprisingly, the folding operation again achieves the "flexing" effect noted above. In this instance, because the waist foldlines are not scored obliquely, the flaps are not urged against the inside walls of the sleeve as the waist fold is made.

Figure 18:
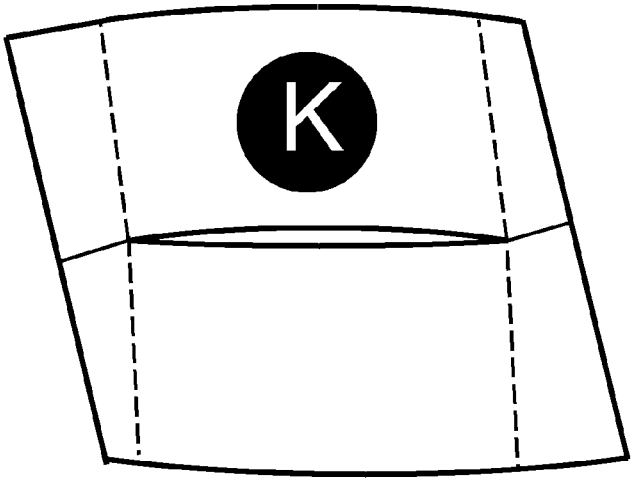
FIG. 18 depicts asymmetrical flaps for folding inside the sleeve.

FIG. 18 depicts asymmetrical flaps for folding inside the sleeve, whereby the sleeves are directed against opposite inside walls during the folding process. Flexibility in the flap design may be useful, for example, in tesselating patterns of multiple panels cut from a single sheet or roll with reduced waste.

Figure 19:
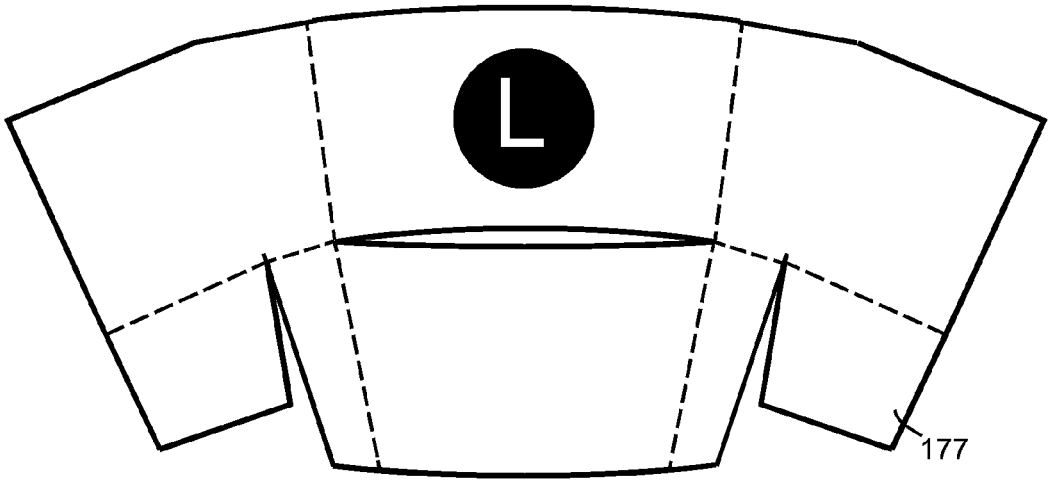
FIG. 19 shows an alternate embodiment having a more complex flap structure for forming a pocket or pouch in the sleeve.

FIG. 19 shows an alternate embodiment having a more complex flap structure for forming a pocket or pouch in the sleeve. In this view, it can be seen that folding results in a 4-layer insulative stack between the cup and the hand of the user, at least around and through the hinge area with accessory flap 177. By combining this technique with embossing, thin paper stocks can readily be built into sleeves having useful insulative properties.

Advantageously, the thin paper stocks are more readily printed with standard printing equipment, including laser and inkjet printers. While not shown, in yet another embodiment, a panel template may be kiss cut from a paper or cardstock adhered to a thin web backing After printing, the panel is peeled off the web layer and folded into a fully assembled sleeve. This offers the possibility of sale of sheets of precut sheets for home use, such as for printing customized commemorative sleeves for special occasions according to the user's own design, and other short-run commercial printing applications. Teachngs of this art are incorporated by reference from U.S. Pat. No. 6,156,252 to Freedman and from the references contained therein.

Figure 20:
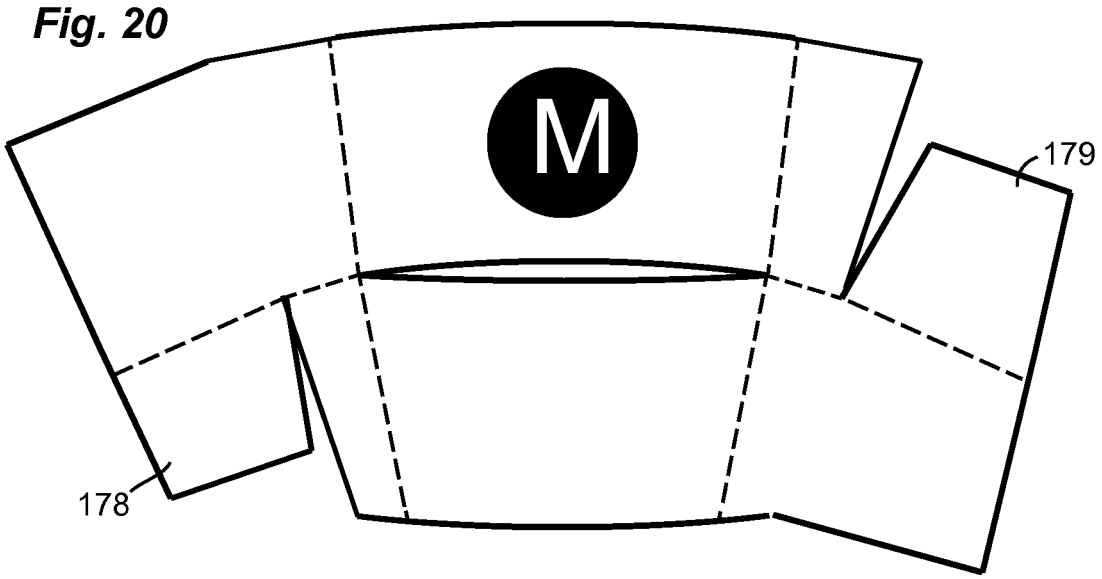
FIG. 20 depicts yet another embodiment having dual pouches, one on each side of the cup.

FIG. 20 depicts yet another embodiment having dual accessory flaps (178, 179), one on each side of the cup. Pouches formed from the accessory flaps may be used for carrying sachets of sugar or crme, for inserting a napkin, or for inserting coupons or other advertising, if desired.

Figure 21:
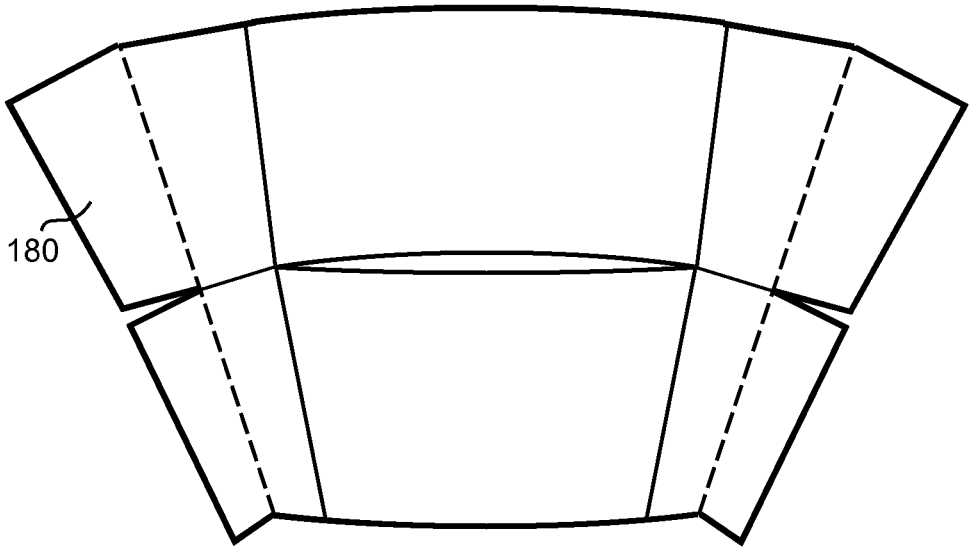
FIG. 21 is a view of a sleeve having pleated flaps.

FIG. 21 is a view of a sleeve having pleated flaps 180. Pleating allows thin layered materials to be built into multi-layered insulative pads having increased "R-values". Pleating may be combined with embossing for further insulation, surprisingly and unexpectedly enabling the use of thin and less expensive paperstock as an insulator.

Figure 22:
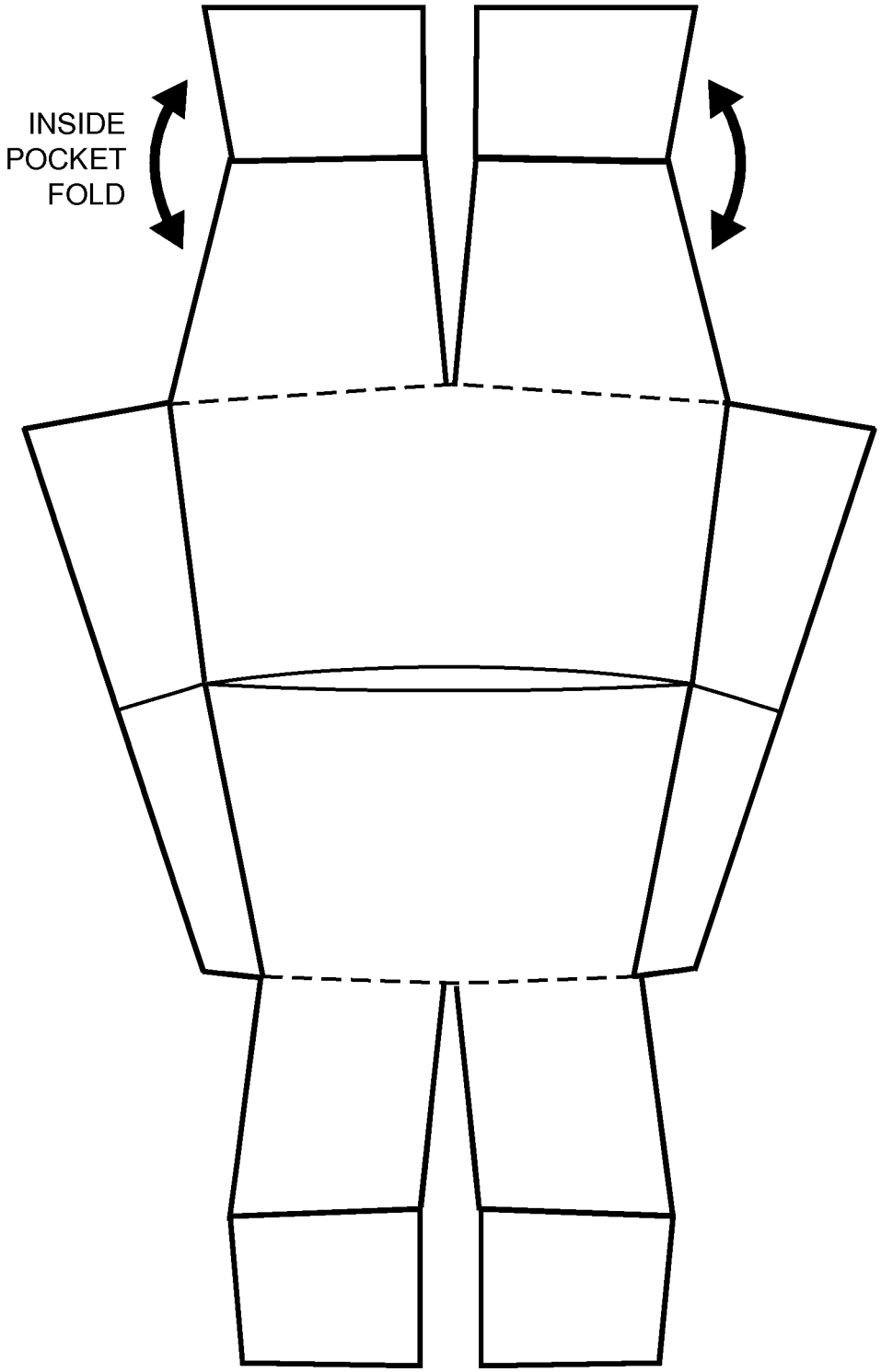
FIG. 22 is a view of a sleeve having multiple layers built up by compound folding flaps.

FIG. 22 is a view of a sleeve having multiple layers built up by compound folding of flaps, again increasing the insulation value of the sleeve thickness, and providing the option of making the resulting pouches useful as pockets for carrying serving accessories, tickets, coupons, and the like.

Figure 23:
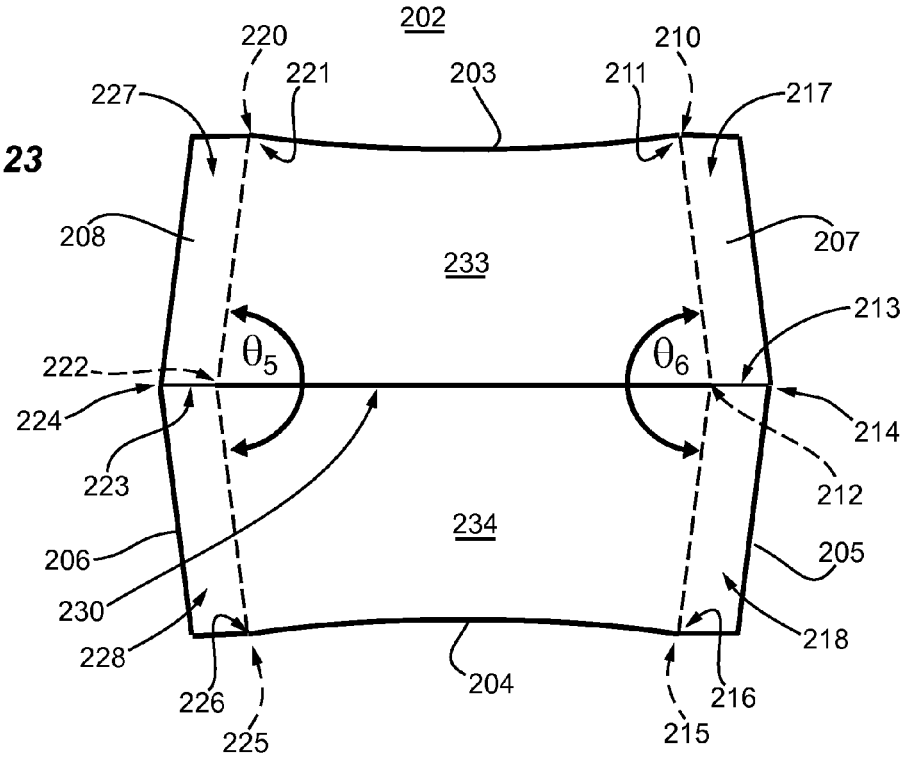
FIG. 23 depicts a template for an alternate embodiment in which the sleeve is folded in an inverted position relative to the sleeves of FIGS. 8-22. In this embodiment, the sleeve folds so that waistline fold axis is at top of sleeve/cup rather than at the bottom.

FIG. 23 depicts a template for an alternate embodiment in which the sleeve is folded in an inverted position relative to the sleeves of FIGS. 8-20. In this embodiment, the sleeve folds so that waistline fold axis is at top of sleeve/cup rather than at the bottom.

The sleeve 200 encloses any flaps and hinge members formed in the folding process. A flat two-sided panel 202 suitable for folding is described. Each panel is provided with a top edge 203 and a bottom edge 204, a right edge 205 and a left edge 206, a right flap 207 and a left flap 208. The precise cut and curvature of the edges may be varied for example as a decorative feature, or to match the roundness of the cup on which the sleeve will be seated. Thus the top and bottom edges may comprise a generally arcuate contour as shown.

The right flap 207 is defined by a right upper flap foldline 210 extending from a rightwardly disposed foldpoint 211 on the top edge 203 to a right waistpoint 212 on a waistline dividing the panel into a upper panel section 233 and a lower panel section 234, and a right lower flap foldline 215 extending from a rightwardly disposed foldpoint 216 on the bottom edge 204 to the right waistpoint 212. The right flap is transected by a right waist foldline 213 extending from the right waistpoint 212 to a lateral foldpoint 214 on the right edge. The right waist foldline 219 divides the right flap into upper and lower right flap partitions (217, 218) joined by a right hinge member 219 articulated by the right waist foldline 213. A slit 230 extending from said right waistpoint 212 to the left waistpoint 222 divides the panel into upper panel section 233 and lower panel section 234.

The upper and lower flap foldlines converge on the waistpoints (212, 222). The angle of convergence ($\theta_5$, $\theta_6$) is obtuse, i.e., not generally >180 degrees, which advantageously causes the sheet to spontaneously flex or "cup" in the process of folding. The obtuse angle at the right waistpoint (double arrow, $\theta_1$) and the obtuse angle at the left waistpoint (double arrow, $\theta_2$) are generally equal and opposite.

In a first step, folding begins with the flaps (207, 208). Both flaps are folded on the right and left flap foldlines so that said flaps are folded inwardly as shown in FIG. 24.

The surface of the panel contacting the flaps as folded will become the inside wall of the sleeve. However, the direction of folding may be reversed by flipping over the panel. Advantageously, this permits the user to choose which of two commercial messages or other graphical indicia are displayed by orienting the panel as desired before making the first folds.

In a second step, the panel is hingedly folded on the waistline foldlines (213, 223). The flaps (207,208) become locked between the upper panel section and the lower panel section of the panel when folded in this way, and are thus not exposed so as to cause accidents or to interfere with drinking from the lip of the cup. In this instance, the hinges become exposed at the top of the sleeve, differentiating this embodiment from the folding art described in FIG. 2.

Figure 24:
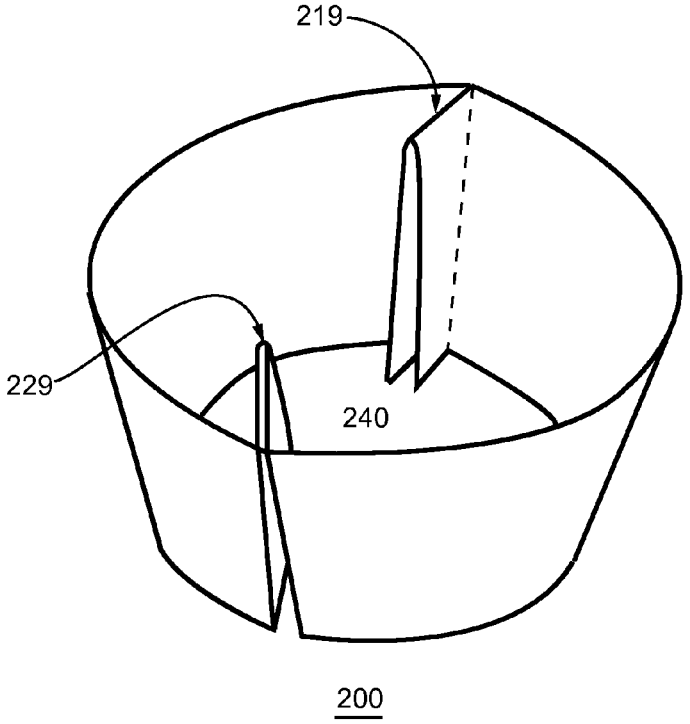
FIG. 24 depicts a sleeve of FIG. 23 in the fully folded position with hinge region topmost and having a generally conical reverse taper.

In preparation for use, the folded sleeve is opened as shown in FIG. 24, so that a cup may be inserted into the central passageway 240. In this embodiment of a foldable sleeve, the hinge members (219, 229) are topmost and the sleeve has a generally conical reverse taper. Optionally, edges 203 and 204 may include additional flaps disposed so as to be folded and tabbed as a base panel of the sleeve.

Figure 25:
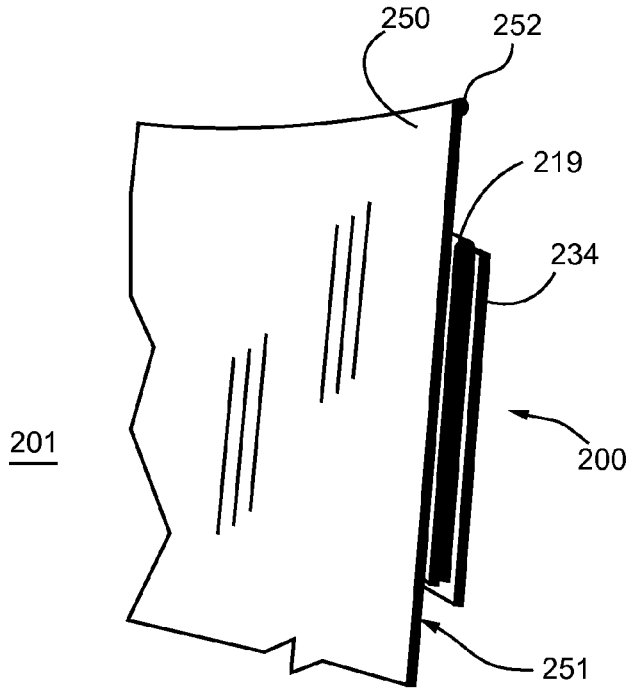
FIG. 25 shows in cross-section how the structure of the inverted sleeve embodiment assembly differs from the sleeve of FIG. 6.

FIG. 25 shows in cross-section how the structure of the inverted sleeve embodiment assembly differs from the sleeve of FIG. 6. FIG. 25 is a view through a cup 201 jacketed by a sleeve 200 in cross-section, showing three overlapping layers of the folding sleeve in the hinge region 219, including an exterior layer 234. The cup includes an inside wall 250, an outside wall 251, and reinforced lip 252. The hinged region 219, which corresponds to the folded flap 229, is shown to be locked between the outside wall 251 of the cup and the outer panel layer 234 of the sleeve.

Figure 26:
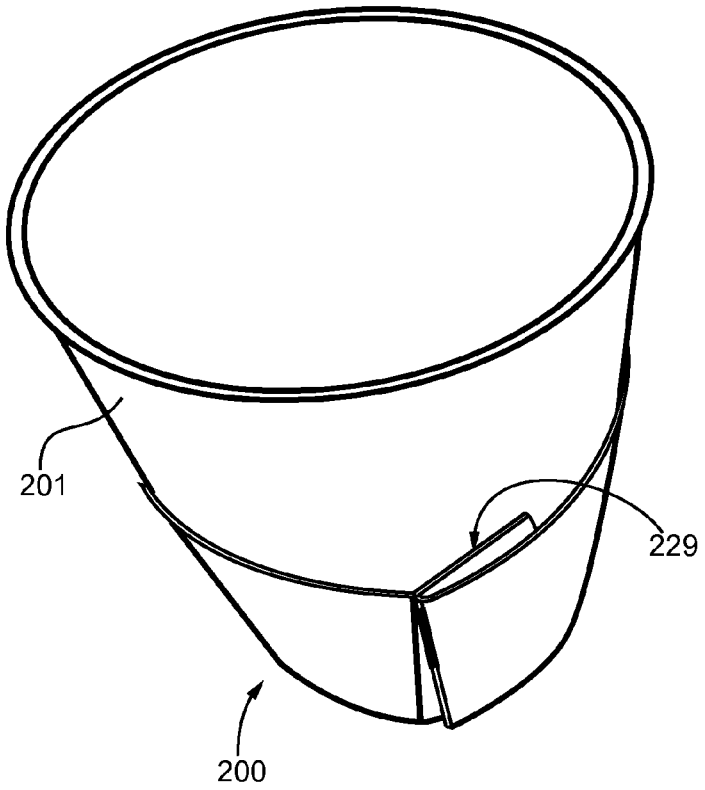
FIG. 26 depicts the sleeve of FIG. 24 inserted onto a frustroconical cup such as a beverage cup.

FIG. 26 depicts the sleeve 200 of FIGS. 23-25 inserted onto a frustroconical cup such as a beverage cup 210. Hinge member 229 is exposed on the superior margin of the sleeve.

Figure 27:
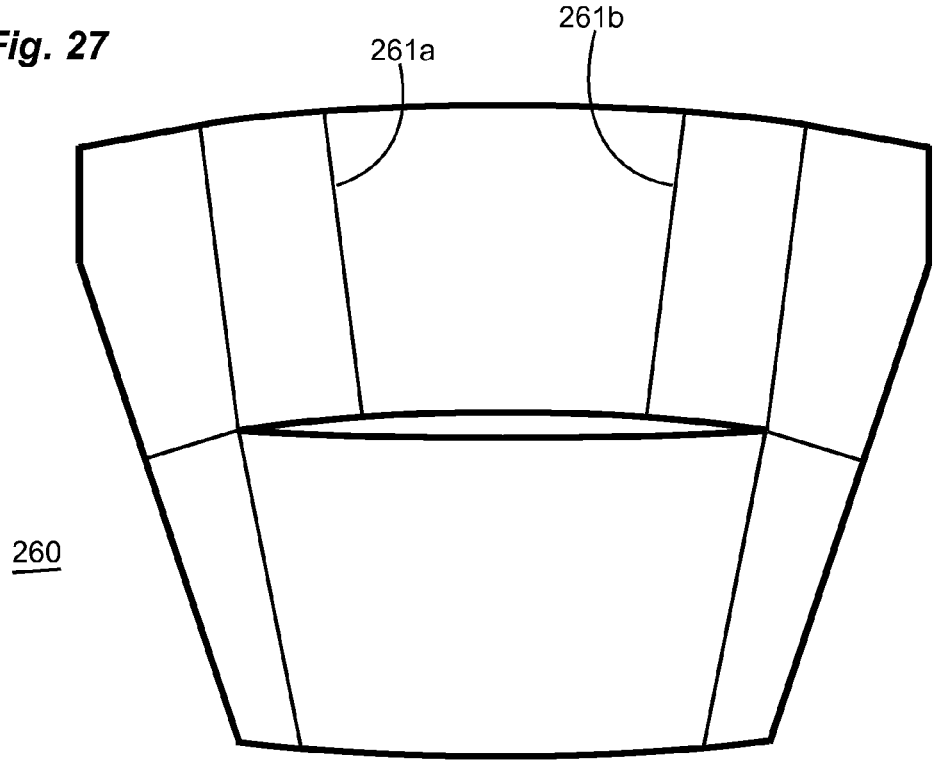
FIG. 27 is a view of a sleeve template having secondary foldlines for forming a rectilinear sleeve shape.
Figure 28:
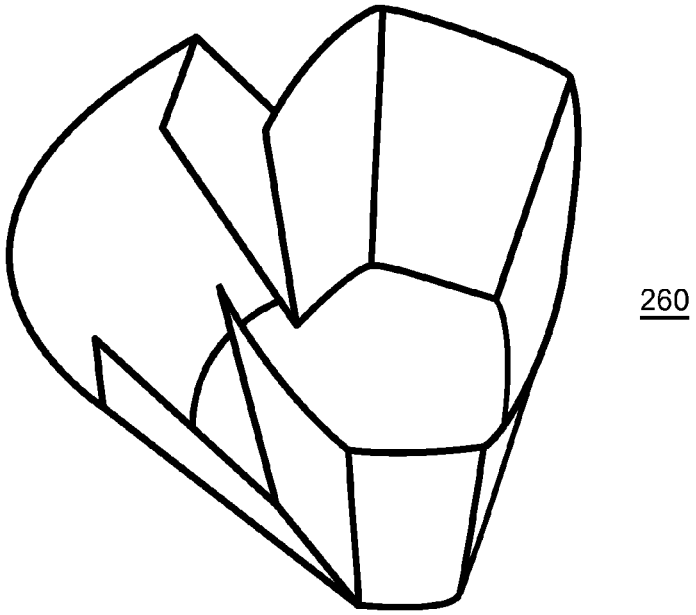
FIG. 28 shows a sleeve having a generally rectilinear shape as folded from the template of FIG. 27.
Figure 29:
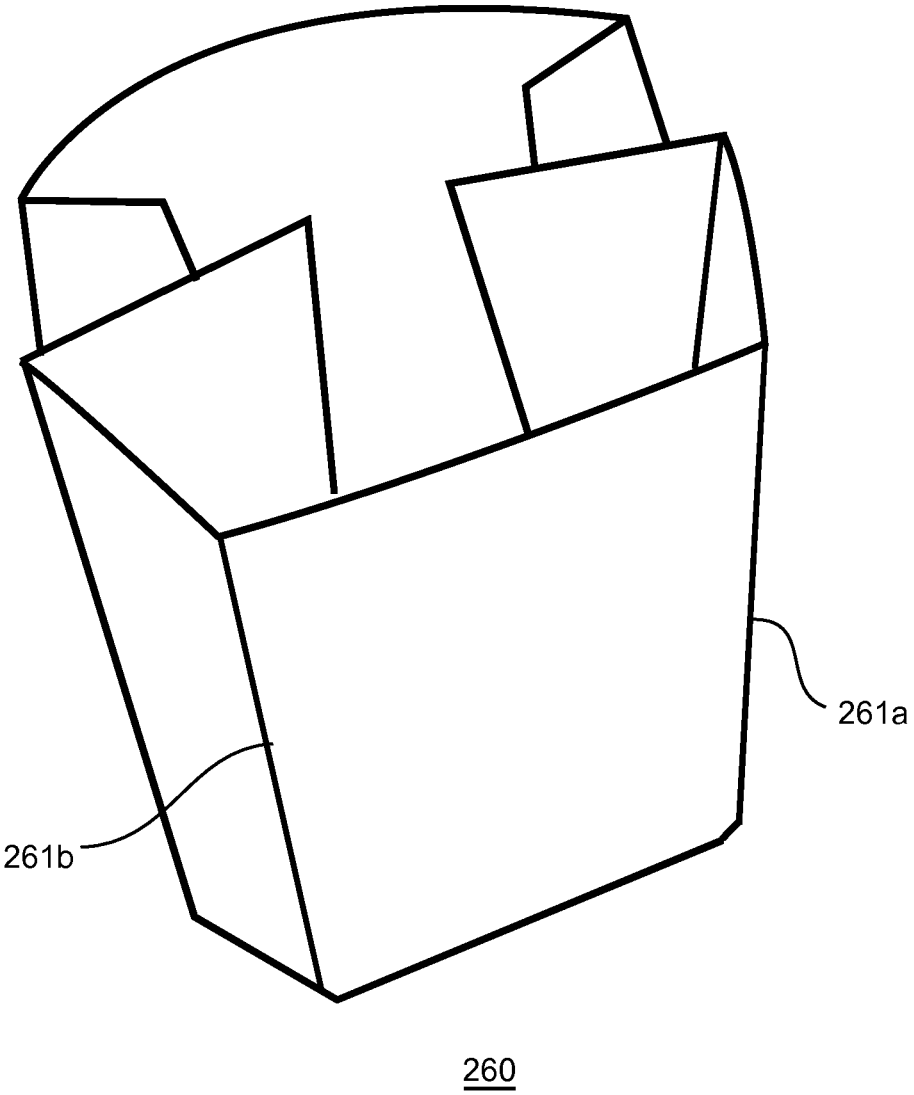
FIG. 29 is a second view of the rectilinearly folded sleeve of FIGS. 27-28.

FIG. 27 is a view of a sleeve template 260 having secondary foldlines (261*a*, 261*b*) for forming a more rectilinear sleeve shape. FIG. 28 shows the sleeve 260 having a generally rectilinear shape as folded from the template of FIG. 27. Advantageously, a sleeve of this kind may be adapted to insert around a generally rectangular object, such as a food service box, a towelette with utensils, or even a pair of socks. FIG. 29 is a second view of the rectilinearly folded sleeve of FIGS. 27-28. While not shown, related folding arts may shift fold line 261*b* to the lower panel section, for example, resulting in a yet more rectangular sleeve. Accessory panels may be used to form sleeves having at least one closed sleeve end.

INCORPORATION BY REFERENCE

All of the U.S. patents, U.S. patent application publications, U.S. patent applications, foreign patents, foreign patent applications and non-patent publications referred to in this specification and related filings are incorporated herein by reference in their entirety.

Scope of Claims

While the above is a complete description of selected embodiments of the present invention, it is possible to practice the invention use various alternatives, modifications, combinations and equivalents. In general, in the following claims, the terms used in the written description should not be construed to limit the claims to specific embodiments described herein for illustration, but should be construed to include all possible embodiments, both specific and generic, along with the full scope of equivalents to which such claims are entitled. Accordingly, the claims are not limited by the disclosure.

I claim:

1. A method for making a cup sleeve from a flat panel of a foldable material, the sleeve having inside dimensions for jacketing a cup, the method comprising:

(a) providing a two-sided flat said panel having a top edge, a bottom edge, a right edge, a left edge, a right flap, a left flap, and a waistline extending from said right edge to said left edge and crossing said right flap and said left flap, said waistline defining an upper panel section above said waistline and a lower panel section below said waistline;

wherein, (i) said right flap is defined by a right upper flap foldline extending from a rightwardly disposed foldpoint on said top edge to a right waistpoint rightwardly disposed on said waistline, and a right lower flap foldline extending from a rightwardly disposed point on said right edge to said right waistpoint, and further wherein said right flap is partitioned between said upper panel section and said lower panel section by a right waist foldline extending from said right waistpoint to a lateral foldpoint on said right edge, said right waist foldline defining a right hinge member dividing said right flap into hingedly foldable upper and lower right flap partitions;

(ii) said left flap is defined by a left upper flap foldline extending from a leftwardly disposed foldpoint on said top edge to a left waistpoint leftwardly disposed on said waistline, and a left lower flap foldline extending from a leftwardly disposed point on said left edge to said left waistpoint, and further wherein said left flap is partitioned between said upper panel section and said lower panel section by a left waist foldline extending from said left waistpoint to a lateral foldpoint on said left edge, said left waist foldline defining a left hinge member dividing said left flap into hingedly foldable upper and lower left flap partitions;

(iii) said right hinge member is obliquely foldable on said right waist foldline relative to said waistline such that said right flap upper foldline and said right flap lower foldline define an obtuse angle (θ4) around said right waistpoint, said left hinge member is obliquely foldable on said left waist foldline relative to said waistline such that said left flap upper foldline and said left flap lower foldline define an obtuse angle (θ3) around said left waistpoint, wherein angles θ3 and θ4 are equal and opposite;

(iv) said upper panel section and said lower panel section are divided by a slit through said panel, said slit extending from said right waistpoint to said left waistpoint and having a slit length equal to half of an intermediate circumference of a cup to be engirdledly jacketed therein;

(b) folding said flaps on said right and left flap foldlines so that said flaps are folded inwardly onto a first side of said panel;

(c) hingedly folding said lower panel section inwardly-onto said first side of said panel over said upper panel section on said hinge members formed by said waistline foldlines and thereby locking said right and left flaps between said upper panel section and said lower panel section of said panel as folded;

(d) with slit downwardly disposed, opening a generally annular center passageway between an inside wall of said upper panel section and an inside wall of said lower panel section, thereby forming an open sleeve with outside sleeve walls and inside sleeve walls; and, (e) inserting the cup into said center passageway of said sleeve and through said slit until engirdledly seated therein, thereby locking said right and left flaps between said inside sleeve walls and a sidewall of the cup engirdledly jacketed therein.

2. The method of claim 1, wherein step (a) is performed by a supplier and steps (b) through (e) are performed by an end user.

3. The method of claim 1, wherein steps (a) through (c) are performed by a supplier and steps (d) through (e) are performed by an end user.

4. The method of claim 1, wherein foldlines in said panel are formed by a process of perforating, creasing, scoring, kiss-cutting, or a combination thereof, as supplied.

5. The method of claim 1, wherein said right and left lower flap fold lines are arcuately creased, scored, kiss cut, or perforated as supplied.

6. The method of claim 1, further comprising a step for offset or laser printing an image on one side or on two sides of said panel as supplied.

7. The method of claim 6, including a step for selecting one of said two sides of said flat panel to be displayed by orientedly folding said flaps on said right and left flap foldlines over said first side of said panel and folding said upper panel section over said lower panel section on said waistline foldlines over said first side, thereby forming a sleeve having a second side outwardly displayed in step (d).

8. The method of claim 1, wherein said slit comprises a knockout piece and said method comprises removing said knockout piece.

9. The method of claim 1, wherein said panels are made from foldable materials selected from paper, cardboard, cardstock, sheetstock, plastic, laminate, fabric, or rubber.

10. The method of claim 9, wherein said panels as supplied comprise embossed, textured, layered, or exploded materials.

11. The method of claim 9, wherein said panel is die-cut or laser cut from a unitary sheet or roll.

12. The method of claim 1, further comprising applying glue onto said upper or lower flap partitions before locking said right and left flaps between said upper panel section and said lower panel section of said panel as folded.

13. The method of claim 1, further comprising printing glue dots on or applying hot glue to said flaps before folding said sleeve.

14. The method of claim 13, wherein a step for applying adhesive to said flaps is performed before said steps (d) through (e).

15. The method of claim 13 wherein said step for applying adhesive to said flaps is performed using a machine.

16. The method of claim 15, comprising boxing folded sleeves and shipping the boxed sleeves to an end user for performing step (e).

17. The method of claim 1, which comprises folding said flaps inwardly at said center waistline slit; folding said panels above and below said center waistline slit onto each other, inside face against inside face; and gluing at least one said flap to one said inside face.

18. The method of claim 17, wherein said lower flap is truncated as a triangular flap or gusset and smaller than said upper flap segment and said foldlines are angled for flexing during the folding process.

* * * * *